US006414666B1

(12) United States Patent
Yamakawa et al.

(10) Patent No.: US 6,414,666 B1
(45) Date of Patent: Jul. 2, 2002

(54) LIQUID CRYSTAL DISPLAY DEVICE AND METHOD OF DRIVING A LIQUID CRYSTAL DISPLAY ELEMENT

(75) Inventors: Eiji Yamakawa, Sanda; Hideaki Ueda, Kishiwada; Naoki Masazumi, Kobe, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/291,765

(22) Filed: Apr. 14, 1999

(30) Foreign Application Priority Data

Apr. 15, 1998 (JP) ..... 10-104359
Mar. 3, 1999 (JP) ..... 11-056061

(51) Int. Cl.[7] ..... G09G 3/36
(52) U.S. Cl. ..... 345/95; 345/87; 345/89; 345/94
(58) Field of Search ..... 345/87, 89, 94, 345/95

(56) References Cited

U.S. PATENT DOCUMENTS 5,252,954 A * 10/1993 Nagata et al. ..... 345/95
5,384,067 A 1/1995 Doane et al. ..... 252/299.01
6,222,517 B1 * 4/2001 Iba et al. ..... 345/94

FOREIGN PATENT DOCUMENTS

JP 9-138381 5/1997

* cited by examiner

*Primary Examiner*—Chanh Nguyen
*Assistant Examiner*—Fritz Alphonse
(74) *Attorney, Agent, or Firm*—Sidley Austin Brown & Wood LLP

(57) ABSTRACT

A method of driving a liquid crystal display element having a first substrate provided with a scanning electrode, a second substrate provided with a signal electrode and a liquid crystal display layer held between the first and second substrates, the method comprising the steps of:

(a) applying a first pulse voltage to the scanning electrode corresponding to a drive target pixel in the liquid crystal display layer for changing the liquid crystal material of the target pixel to a predetermined changed state;

(b) applying, subsequent to the step (a), a second pulse voltage to the scanning electrode corresponding to the target pixel; and (c) controlling a pulse width of a third pulse voltage in accordance with a required display tone of the target pixel, and applying the third pulse voltage to the signal electrode corresponding to the target pixel in synchronization with the second pulse voltage for stabilizing the state of the liquid crystal material of the target pixel in a predetermined stabilized state.

26 Claims, 14 Drawing Sheets

Sc.E: scanning electrode
Sg.E: signal electrode

Sc.E: scanning electrode
Sg.E: signal electrode

| A | comparator output | B | C | output |
|---|---|---|---|---|
| 1 | 1 | 0 | 0 | 0 |
| | 0 | 0 | 1 | 1 |
| 0 | 1 | 1 | 0 | 1 |
| | 0 | 0 | 0 | 0 |

Sc.E: scanning electrode
Sg.E: signal electrode

Sc.E: scanning electrode
Sg.E: signal electrode

LIQUID CRYSTAL DISPLAY DEVICE AND METHOD OF DRIVING A LIQUID CRYSTAL DISPLAY ELEMENT

This application is based on patent application Nos. H10-104359 (104359/1998) Pat. and H11-56061 (56061/1999) Pat. both filed in Japan, the contents of which are hereby incorporated by reference.

BACKGROUND OF THE INVENTION

1. Field of the Invention

The present invention relates to a display device including a liquid crystal display element, and particularly a display device including a liquid crystal display element having a liquid crystal display layer which includes liquid crystal and resin. The invention also relates to a method of driving a liquid crystal display element, and particularly a method of driving a liquid crystal display element having a liquid crystal display layer which includes liquid crystal and resin.

2. Description of the Background Art

A liquid crystal display element including liquid crystal material which exhibits a cholesteric characteristic does not require a polarizer, and can perform a bright reflective display because it utilizes selective reflection of incident light by the liquid crystal material. Further, it can perform a high resolution display by simple matrix driving without requiring a memory element such as TFT or MIM.

When driving the liquid crystal display element which includes the liquid crystal material exhibiting the cholesteric characteristic by application of the voltage, two kinds of, i.e., high and low pulse voltages are applied to the liquid crystal layer for switching the orientation state of the liquid crystal molecules between the planar orientation state and the focal conic orientation state. When the liquid crystal layer is supplied with a high pulse voltage, which can orient the helical axes of the liquid crystal along the electric field direction and thus can achieve a homeotropic orientation, the liquid crystal will enter the planar state, in which the helical axes of the liquid crystal molecules forming each domain are perpendicular to the substrate, after the high pulse voltage application stops. When the liquid crystal layer is supplied with a low pulse voltage, which cannot achieve the complete homeotropic state of the liquid crystal, the liquid crystal material will enter the focal conic state, in which the helical axes of the liquid crystal molecules forming each domain are oriented irregularly or substantially parallel with the substrate, after the low pulse voltage application stops. The planar state and the focal conic state are stably held even after stop of the voltage application.

The liquid crystal material exhibiting the cholesteric characteristic selectively reflects the rays of a wavelength corresponding to a product of the helical pitch and the average refractive index of the liquid crystal material when it is in the planar orientation. Therefore, by employing the liquid crystal materials of which selective reflection wavelengths are in a red range, a blue range and a green range, respectively, the liquid crystal materials in the planar orientation selectively reflect the rays of the respective wavelengths to perform display in red, blue and green. When the liquid crystal material exhibiting the cholesteric characteristic has a short helical pitch, for example, has such a short helical pitch that the selective reflection wavelength is in a visible range or below the visible range, the liquid crystal material in the focal conic state scatters the visible rays to a less extent so that a nearly transparent appearance can be exhibited.

Accordingly, by employing the liquid crystal material, which has a selective reflective wavelength in the visible range and exhibits the cholesteric characteristic, together with a black background, and by switching the state between the planar state and the focal conic state, the display in the selective reflection state (planar state) and the black state (focal conic state) can be selectively performed.

By employing the liquid crystal material having the selective reflection wavelength, e.g., in an infrared range, the liquid crystal material in the planar state exhibits a transparent appearance because it reflects only the infrared rays, i.e., the rays of the selective reflection wavelength, and allows passage of visible rays and others. In this case, the helical pitch is relatively long so that the liquid crystal material in the focal conic state scatters the incident rays to exhibit an opaque appearance.

Accordingly, by using the liquid crystal material, which has the selective reflection wavelength in the infrared range and exhibits the cholesteric characteristic, together with the black background, the display in black (planar state) and white (focal conic state) can be selectively performed by switching the state between the planar state and the focal conic state.

In the liquid crystal display element including twist nematic liquid crystal material, supertwist nematic liquid crystal material or the like, the state of liquid crystal material changes in accordance with the effective value of the drive voltage. Therefore, the simple matrix driving cannot achieve a practically sufficient contrast if the pixels are large in number. However, the liquid crystal display element including the liquid crystal material which exhibits the cholesteric characteristic has the memory property as already described, and therefore, can be driven by the simple matrix driving to achieve a practically sufficient contrast even if the pixels are large in number.

U.S. Pat. No. 5,384,067 has disclosed the following prior art. A liquid crystal display element having a liquid crystal composite film, which is formed of polymerized and phase-separated chiral nematic liquid crystal and resin, is supplied with a pulse voltage for driving. The pulse voltage has a magnitude intermediate the voltage, which can set the whole liquid crystal material in the composite film to the planar state, and the voltage, which can set the whole liquid crystal material to the focal conic state. The magnitude of this voltage is controlled so that the composite film attains the state, in which the domains in the planar state and the domains in the focal conic state are present in a mixed fashion, and thereby the gray-scale display can be performed.

In addition to the above, the following art has been studied. A liquid crystal display element having a composite film, which is formed of liquid crystal material exhibiting the cholesteric characteristic and resin, is supplied with a first pulse voltage having a magnitude achieving the homeotropic state, in which the molecules of the liquid crystal are oriented parallel with the electric field. After a predetermined time from the application of the first pulse voltage, a second pulse voltage is applied for stabilizing the composite film. The magnitude of the second pulse voltage is controlled so that display in intended levels can be performed.

However, when employing the method of driving the liquid crystal display element, in which multiple-tone display is performed by controlling the magnitude of the pulse voltage, as disclosed in U.S. Pat. No. 5,384,067 as well as the method of driving the liquid crystal display element by applying the first and second pulse voltages, expensive analog ICs are required in drive circuits connected to the liquid crystal display elements, and therefore the display device is expensive as a whole.

SUMMARY OF THE INVENTION

An object of the invention is to provide a liquid crystal display device using a liquid crystal display element, and particularly to provide a liquid crystal display device which can inexpensively perform display in multiple tone levels.

Another object of the invention is to provide a liquid crystal display device using liquid crystal display element, which is provided with liquid crystal display layer including liquid crystal material exhibiting a cholesteric characteristic, and particularly to provide a liquid crystal display device which can inexpensively perform display in multiple tone levels.

Still another object of the invention is to provide a method of driving a liquid crystal display element which can inexpensively perform display in multiple tone levels.

Yet another object of the invention is to provide a method of driving a liquid crystal display element, which is provided with a liquid crystal display layer including liquid crystal material exhibiting a cholesteric characteristic, and particularly to provide a method of driving a liquid crystal display element which can inexpensively perform display in multiple tone levels.

The invention provides a liquid crystal display device comprising a liquid crystal display element having a first substrate provided with a plurality of scanning electrodes, a second substrate provided with a plurality of signal electrodes and a liquid crystal display layer held between the first and second substrates; and a drive voltage applying device for applying a scanning voltage to the scanning electrodes and applying a signal voltage to the signal electrodes, wherein the drive voltage applying device applies a first pulse voltage to the scanning electrode corresponding to a drive target pixel in the liquid crystal display layer for changing the liquid crystal material of the target pixel to a predetermined changed state;

applies, subsequently to the first pulse voltage, a second pulse voltage to the scanning electrode corresponding to the target pixel as well as a third pulse voltage to the signal electrode corresponding to the target pixel in synchronization with the second pulse voltage for stabilizing the state of the liquid crystal material of the target pixel in a predetermined stabilized state;

and controls a pulse width of the third pulse voltage in accordance with required display tone of the target pixel.

The invention also provides a liquid crystal display device comprising a liquid crystal display element having a first substrate provided with a plurality of scanning electrodes, a second substrate provided with a plurality of signal electrodes and a liquid crystal display layer held between the first and second substrates; and a drive voltage applying device for applying a scanning voltage to the scanning electrodes and applying a signal voltage to the signal electrodes, wherein the drive voltage applying device applies a first pulse voltage to the scanning electrode corresponding to a drive target pixel in the liquid crystal display layer for changing the liquid crystal material of the target pixel to a predetermined changed state;

applies, subsequently to the first pulse voltage, a second pulse voltage to the scanning electrode corresponding to the target pixel as well as a third pulse voltage having a pulse width equal to or larger than the pulse width of the second pulse voltage to the signal electrode corresponding to the target pixel in synchronization with the second pulse voltage for stabilizing the state of the liquid crystal material of the target pixel in a predetermined stabilized state;

and controls on-timing of the third pulse voltage with respect to on-timing of the second pulse voltage and/or off-timing of the third pulse voltage with respect to off-timing of the second pulse voltage to change the phase of the third pulse voltage with respect to the phase of the second pulse voltage within a range from a state where the second and third pulse voltages do not overlap with each other, to a state where the second pulse voltage is included in the third pulse voltage in accordance with required display tone of the drive target pixel.

The invention also provides a method of driving a liquid crystal display element having a first substrate provided with a scanning electrode, a second substrate provided with a signal electrode and a liquid crystal display layer held between the first and second substrates, the method comprising the steps of:

(a) applying a first pulse voltage to the scanning electrode corresponding to a drive target pixel in the liquid crystal display layer for changing the liquid crystal material of the target pixel to a predetermined changed state;

(b) applying, subsequent to the step (a), a second pulse voltage to the scanning electrode corresponding to the target pixel; and (c) controlling a pulse width of a third pulse voltage in accordance with a required display tone of the target pixel, and applying the third pulse voltage to the signal electrode corresponding to the target pixel in synchronization with the second pulse voltage for stabilizing the state of the liquid crystal material of the target pixel in a predetermined stabilized state.

The invention further provides a method of driving a liquid crystal display element having a first substrate provided with a scanning electrode, a second substrate provided with a signal electrode and a liquid crystal display layer held between the first and second substrates, the method comprising the steps of:

(a) applying a first pulse voltage to the scanning electrode corresponding to a drive target pixel in the liquid crystal display layer for changing the liquid crystal material of the target pixel to a predetermined changed state;

(b) applying, subsequent to the step (a), a second pulse voltage to the scanning electrode corresponding to the target pixel; and (c) applying a third pulse voltage having a pulse width equal to or larger than a pulse width of the second pulse voltage to the signal electrode corresponding to the target pixel, with controlling an on-timing of the third pulse voltage with respect to an on-timing of the second pulse voltage and/or an off-timing of the third pulse voltage with respect to an off-timing of the second pulse voltage to change a phase of the third pulse voltage with respect to a phase of the second pulse voltage within a range from a state where the second and third pulse voltages do not overlap with each other, to a state where the second pulse voltage is included in the third pulse voltage in accordance with a required display tone of the drive target pixel.

The foregoing and other objects, features, aspects and advantages of the present invention will become more apparent from the following detailed description when taken in conjunction with the accompanying drawings.

Figure 1:
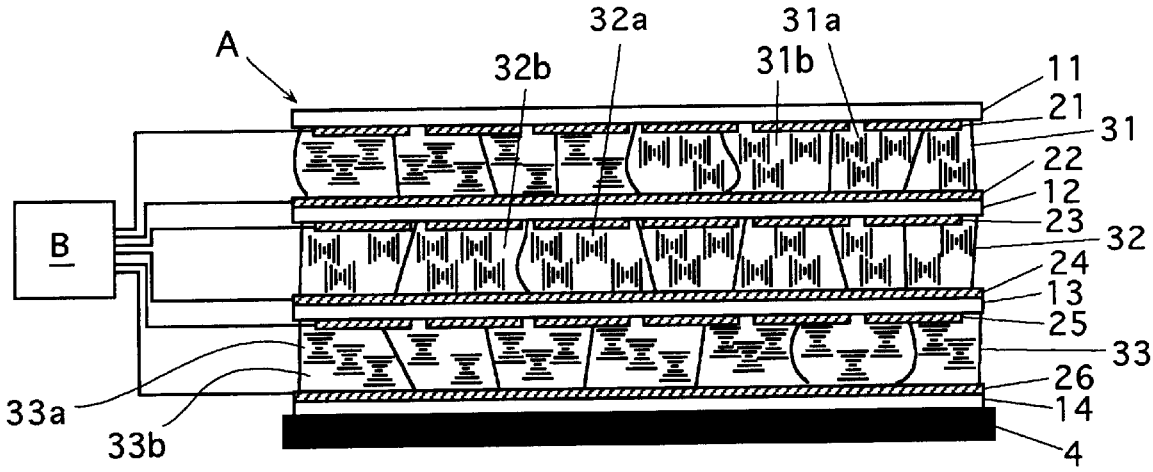
FIG. 1 shows an example of a schematic structure of a liquid crystal display device according to the invention.

DESCRIPTION OF THE PREFERRED EMBODIMENTS (I) In a liquid crystal display device and a method of driving a liquid crystal display element according to the invention, a first pulse voltage is applied to a scanning electrode corresponding to a drive target pixel in the liquid crystal display element. Thereby, the state of the liquid crystal material of the target pixel is changed to a predetermined changed state. By changing the state of the liquid crystal material of the target pixel to a predetermined changed state, an influence (hysteresis phenomenon) of the state of the liquid crystal material before application of the first pulse voltage can be avoided in the following operation.

Subsequent to the application of the first pulse voltage (after the application of the first pulse voltage by a predetermined interval time), a second pulse voltage as well as a third pulse voltage are applied. The second pulse voltage is applied to the scanning electrode corresponding to the target pixel. The third pulse voltage is applied to the signal electrode corresponding to the target pixel in synchronization with the second pulse voltage.

In the application of the third pulse voltage, the pulse width of the third pulse voltage is controlled in accordance with required or intended display tone (gradation level) of the drive target pixel. Thereby, the display tone is controlled.

In the application of the third pulse voltage, alternatively, the third pulse voltage having a pulse width equal to or larger than a pulse width of the second pulse voltage is applied to the signal electrode as following manner. The third pulse voltage is applied in synchronization with the second pulse voltage. On-timing of the third pulse voltage with respect to on-timing of the second pulse voltage, and/or off-timing of the third pulse voltage with respect to off-timing of the second pulse voltage are controlled in accordance with the required display tone of the drive target pixel. Thereby, the phase of the third pulse voltage with respect to the phase of the second pulse voltage is changed in accordance with the required display tone of the drive target pixel within a range from a first state as follows to a second state as follows. The first state is the state where the second and third pulse voltages do not overlap with each other. In other words, the first state is the state in which the phase relationship between the second and third pulse voltages is such that the second and third pulse voltages are not simultaneously applied. The second state is the state where the second pulse voltage is included in the third pulse voltage. In other words, the second state is the state in which the phase relationship between the second and third pulse voltages is such that the second pulse voltage is applied only within a period of application of the third pulse voltage, and further in other words, the phase relationship is such that the third pulse voltage is always applied while the second pulse voltage is applied.

By applying the second and third pulse voltages, or after the application of the second and third pulse voltages, the state of the liquid crystal material of the target pixel, which has been changed in a former step of the application of the first pulse voltage, is stabilized in the predetermined stabilized state, and thereby, the intended display tone of the target pixel can be achieved. By applying the pulse voltages in the above manner to each pixel, the whole display element can perform a display in multiple display tones.

In the liquid display device according to the invention, when the drive voltage applying device applies the scanning voltage to the scanning electrode in the liquid crystal display element as well as the signal voltage to the signal electrode for image display in multiple tone levels, the drive voltage applying device is merely required to perform the following operation. As described above, the drive voltage applying device applies the first pulse voltage to the scanning electrode corresponding to the drive target pixel. Subsequently (after a predetermined time), the drive voltage applying device applies the second pulse voltage to the scanning electrode as well as the third pulse voltage to the signal electrode corresponding to the target pixel in synchronization with the second pulse voltage. In the above voltage applying operation, the drive voltage applying device is required to control only the pulse width of the third pulse voltage in accordance with the required display tone of the drive target pixel for image display in multiple tone levels. Alternatively, in the above voltage applying operation, the drive voltage applying device is required to control only on-timing of the third pulse voltage with respect to on-timing of the second pulse voltage and/or off-timing of the third pulse voltage with respect to off-timing of the second pulse voltage in accordance with the required display tone of the drive target pixel for image display in multiple tone levels. In other words, the drive voltage applying device is not required to control the magnitude of any pulse voltage for image display in multiple tone levels. Therefore, the drive voltage applying device can be formed of, e.g., a relatively inexpensive digital IC which can control on and off of the pulse voltage, and consequently the whole display device can be inexpensive. The method of driving the liquid crystal display element according to the invention can likewise be performed by utilizing, e.g., the inexpensive digital IC which can control on and of the pulse voltage.

The liquid crystal display element, which is used in the liquid crystal display device and the method of driving the liquid crystal display element according to the invention, may typically include a liquid crystal display layer having a liquid crystal material exhibiting a cholesteric characteristic, or having a composite film including liquid crystal exhibiting a cholesteric characteristic and resin. The liquid crystal exhibiting the cholesteric characteristic may be liquid crystal which exhibits the cholesteric characteristic at a service environment temperature (typically at a room temperature).

In the liquid crystal display element provided with the liquid crystal display layer described above, the first pulse voltage may be a voltage for changing the liquid crystal material in the target pixel to a homeotropic state as the predetermined changed state, and the second and third pulse voltages may be voltages for stabilizing the liquid crystal material of the target pixel in a planar state, a focal conic state or a state intermediate the planar and focal conic states as the predetermined stabilized state in accordance with the required display tone level of the target pixel.

The homeotropic state is the state where molecules of the liquid crystal material exhibiting the cholesteric characteristic are oriented parallel to the direction of the electric field. When the voltage application to the liquid crystal material, which has been in the homeotropic state, is stopped, the state of the liquid crystal changes toward the planar state. By setting the liquid crystal to the homeotropic state, it is possible to avoid such a hysteresis phenomenon that the state of liquid crystal after stop of application of the pulse voltage changes depending on the state of liquid crystal before application of the pulse voltage.

For avoiding the hysteresis phenomenon more reliably in any one of the above cases, a fourth pulse voltage may be applied to the signal electrode corresponding to the target pixel in synchronization with the application of the first pulse voltage to the scanning electrode corresponding to the drive target pixel. The fourth pulse voltage is employed for changing the liquid crystal material of the drive target pixel to the predetermined changed state together with the first pulse voltage applied to the scanning electrode corresponding to the drive target. In this case, the drive voltage applying device in the liquid crystal display device may be adapted to allow application of the above fourth pulse voltage.

The fourth pulse voltage may have the polarity opposite to that of the first pulse voltage for avoiding more reliably the hysteresis phenomenon by increasing the potential difference between the scanning electrode and the signal electrode.

The third pulse voltage may have the polarity opposite to that of the second pulse voltage.

In the liquid crystal display device and the method of driving the liquid crystal display element according to the invention, it is not necessary that the magnitudes of the first and second pulse voltages are equal to each other, however, the magnitudes of the first and second pulse voltages may be equal to each other. If the magnitudes of the first and second pulse voltages are set to be equal to each other, the drive circuit and/or the drive voltage applying device can have simple and inexpensive structures. This is true also with respect to the third and fourth pulse voltages.

For further simple and inexpensive structures of the drive circuit and/or the drive voltage applying device, each scanning electrode corresponding to the drive target pixel may be supplied with the first and second pulse voltages of at least the same magnitude. For example, it is assumed that the first pulse voltage of 140 V and the second pulse voltage of 140 V are applied to a certain scanning electrode. In this case, the first pulse voltage of 140 V and the second pulse voltage of 140 V may likewise be applied to the other scanning electrodes.

Each signal electrode corresponding to the drive target pixel may be supplied with the third pulse voltage of the same magnitude, or may be supplied with the third and fourth pulse voltages of the same magnitude.

In any one of the above cases, the drive voltage applying device in the display device according to the invention may be constructed to perform the voltage application in the above manner.

In any one of the above cases, the first pulse voltage may be formed of a single pulse voltage, or may be formed of a plurality of pulse voltages. If the first pulse voltage is formed of the a plurality of pulse voltages, all the pulse voltages may have the same polarity, or one or some of them may have the polarity opposite to that of the others. If the first pulse voltage is formed of a plurality of pulse voltages, the pulse interval of these pulse voltages may be zero. The above is true also with respect to the second, third and fourth pulse voltages. If the third pulse voltage is formed of a plurality of pulse voltages, and when the pulse widths of these pulse voltages are controlled in accordance with required display tone of the drive target pixel, one, some or all of these pulse voltages may have a pulse width(s) of zero in a certain timing. If the third pulse voltage is formed of a plurality of pulse voltages, and when the on-timing and/or off-timing of these pulse voltages are controlled in accordance with required display tone level of the drive target pixel, one, some or all of these pulse voltages may have a pulse width(s) of 0 in a certain timing.

(II) Embodiments of the invention will now be described with reference to the drawings.

(II-1) FIG. 1 schematically shows an example of a liquid crystal display device according to the invention. This device includes a liquid crystal display element A and a drive circuit B (an example of a drive voltage applying device) connected to the element A. The liquid crystal display element A includes blue, green and red display layers 31, 32 and 33, each of which is held between a pair of transparent substrates or plates, and can selectively perform display in corresponding color (i.e., blue, green or red) and transparent display. These layers 31, 32 and 33 form a layered structure, and can perform display in multiple colors. The blue, green and red display layers 31, 32 and 33 are arranged in this order from the observer side.

The blue display layer 31 is held by transparent substrates 11 and 12, which are provided with a plurality of transparent electrodes 21 and 22 opposed to the layer 31, respectively. The green display layer 32 is held by the transparent substrates 12 and 13, which are provided with a plurality of transparent electrodes 23 and 24 opposed to the layer 32, respectively. The transparent substrate 12 holds both the display layers 31 and 32, and is provided at its opposite surfaces with the transparent electrodes 22 and 23. The red display layer 33 is held by the transparent substrates 13 and 14 which are provided with transparent electrodes 25 and 26 opposed to the layer 33, respectively. The transparent substrate 13 holds both the display layers 32 and 33, and is provided at its opposite surfaces with the transparent electrodes 24 and 25, respectively. A black light absorbing layer 4 is arranged on the outer side (i.e., side remote from the observer) of the transparent substrate 14.

The drive circuit B includes drivers for applying voltages to display layers 31, 32 and 33. The transparent electrodes 21, 22, 23, 24, 25 and 26 are connected to the drive circuit B.

Each of the display layers 31, 32 and 33 in this embodiment is formed of a composite film of liquid crystal and resin, which is prepared by polymerization phase separation of the liquid crystal material and resin precursor (resin raw material).

The foregoing liquid crystal material may typically be a liquid crystal material exhibiting a cholesteric characteristic in a service environment temperature (room temperature). The liquid crystal material exhibiting the cholesteric characteristic may typically be a cholesteric liquid crystal material. The cholesteric liquid crystal material has a layer structure in which long axes of the liquid crystal molecules are oriented parallel with each other, and long axes of neighboring molecules in each molecule layer are slightly shifted from each other to form a helical structure.

In addition to the above, the liquid crystal material exhibiting the cholesteric characteristic may be chiral nematic liquid crystal formed of nematic liquid crystal material and chiral dopant added thereto for providing an intended helical pitch. In the chiral nematic liquid crystal, the helical pitch of the liquid crystal exhibiting the cholesteric characteristic can be changed by changing the amount of chiral dopant added thereto, and thereby the liquid crystal can have an intended selective reflection wavelength. The helical pitch means the pitch of the helical structure of the liquid crystal molecules, and is equal to a distance between the molecules, which are angularly spaced by 360 degrees along the helical structure of the liquid crystal molecules.

In the nematic liquid crystal, rod-like liquid crystal molecules are parallel with each other, but do not form a layered structure. The nematic liquid crystal may contain biphenyl, tolane, pyrimidine, cyclohexane or the like, or may contain a mixture of some of these substances. In particular, the substance having the positive dielectric anisotropy is preferable. More specifically, cyanobiphenyl-contained K15 (manufactured by Merck Co., Ltd.), M15 (manufactured by Merck Co., Ltd.), liquid crystal mixture MN1000XX (manufactured by Chisso Co., Ltd.) as well as E44, ZLI-1565, BL009, TL-213, BL-035 and MLC6436 (all manufactured by Merck Co., Ltd.) and others may be available.

The chiral dopant is an additive which functions to twist the molecules of nematic liquid crystal when added to the nematic liquid crystal material. By adding the chiral dopant to the nematic liquid crystal material, the liquid crystal molecules can have the spiral structure having a predetermined twist distance so that the cholesteric characteristic is exhibited.

The chiral dopant may be a compound having asymmetric carbon, and more specifically may be S-811, CB15, S1011, CE2 (all manufactured by Merck Co., Ltd.) and others. Cholesteric nonanoate CN (manufactured by Merck Co., Ltd.) which is a cholesteric liquid crystal material may be used as a chiral dopant.

The chiral dopant may be formed of a mixture of several kinds of chiral dopant, which can induce the same rotary polarization or can induce different kinds of rotary polarization. By using several kinds of chiral dopant, of which specific types and a mixing rate are appropriately selected or adjusted, it is possible to control properties of the liquid crystal exhibiting a cholesteric characteristic such as a phase transition temperature, dielectric anisotropy $\Delta\in$, a refractivity anisotropy $\Delta n$ and/or viscosity $\eta$, and it is also possible to reduce variations in selective reflection wavelength due to change in temperature. Owing to these control and adjustment, the characteristics as the liquid crystal display element can be improved.

The resin raw material may preferably be photo-curing (e.g., ultraviolet-curing) monomers and/or oligomers, and more specifically may preferably be monofunctional or multifunctional monomers and/or oligomers of acrylate, methacrylate, epoxy or the like in view of a mutual action with the liquid crystal material, reliability, adhesivity to the plate and others. More specifically, the resin raw material may be R-128H, R-712, R-551, TPA-320 (all manufactured by Nippon Kayaku Co., Ltd.), adamantile methacrylate, or BF-530 (manufactured by Daihachi Kagaku Co., Ltd.). The photo-curing resin such as ultraviolet-curing resin facilitates control of start and stop of polymerization as well as control of portions to be polymerized.

The "substrates" holding the display layer may conceptually include flexible or less flexible plate-like members, flexible films or the like. Among the substrates holding the display layers, the substrate 11 arranged on the uppermost position may be a film protecting the display layer 31, and the other substrates 12, 13 and 14 may be plates having a hardness enough to hold the display layers 31, 32 and 33. The substrates may be made of glass, polyethylene terephthalate, polycarbonate, polyether sulfone or the like.

The transparent electrode may be made of ITO (Indium Tin Oxide), $SnO_2$ or the like. The transparent electrode may be formed on the substrate by sputtering, vapor deposition or the like. The electrode 26 which is remotest from the observer may be black so that it can serve also as a portion of the light absorbing layer.

Each of the electrodes 21, 22, 23, 24, 25 and 26 are band-like electrodes which are arranged parallel to each other with fine spaces therebetween, although not restricted to this structure. The electrodes 21, 23 and 25 are signal electrodes, respectively, and the electrodes 22, 24 and 26 are scanning electrodes, respectively. The signal electrodes are perpendicular to the scanning electrodes.

The light absorbing layer 4 may be formed of, e.g., a black film. Either surface of the substrate 26 remotest from the observer may be coated with black paint forming the light absorbing layer.

The liquid crystal display element A described above can be manufactured, e.g., as follows. The substrate 11 provided with the electrodes 21, the substrate 12 provided at its opposite surfaces with the electrodes 22 and 23, the substrate 13 provided at its opposite surfaces with electrodes 24 and 25, and the substrate 14 provided with the electrodes 26 are arranged to form an assembly with particle-like or rod-like spacers therebetween. In this assembly, the electrodes 21, 23 and 25 are opposed to the electrodes 22, 24 and 26, respectively. The spacers are employed for controlling the thickness of the liquid crystal display layers. The black light absorbing layer 4 is arranged outside the substrate 14.

Then, a mixture of the resin raw material, liquid crystal material and photo-polymerization initiator is applied to spaces between the substrates. If the chiral nematic liquid crystal prepared by adding the chiral dopant to the nematic liquid crystal is used, the quantity of added chiral dopant is controlled to control the helical pitches of the chiral nematic liquid crystal material for producing three kinds of liquid crystal materials having selective reflection wavelengths in the blue, green and red regions, respectively. The space between the substrates 11 and 12 is filled with the mixture containing the liquid crystal material which has the selective reflection wavelength in the blue region. The spaces between the substrate 12 and 13 is filled with the mixture containing the liquid crystal material which has the selective reflection wavelength in the green region. The spaces between the substrate 13 and 14 is filled with the mixture containing the liquid crystal material which has the selective reflection wavelength in the red region.

The polymerization initiator may be a material which induces radical polymerization of resin when irradiated with light (e.g., ultraviolet light). More specifically, the polymerization initiator may be, for example, DAROCUR 1173 or IRGACUR 184 (both manufactured by Chiba Gaigy Co., Ltd.) which induces radical polymerization of resin when irradiated with ultraviolet light.

The mixtures held between the substrates are irradiated with light such as ultraviolet light to curing the resin raw material so that the phase separation occurs between the liquid crystal and the resin. The peripheries of the substrates are sealed. In this manner, liquid crystal display element A is obtained. The drive circuit B is connected to the transparent electrodes 21, 22, 23, 24, 25 and 26 of the liquid crystal display element A.

In this embodiment, the substrates 12 and 13 are made of plates, each of which is provided at its opposite surfaces with the electrode layers 22 and 23, or electrode layers 24 and 25. The substrates 11, 12, 13 and 14 are arranged to form an assembly with the spacers therebetween. Then, the three regions between the substrates are filled with the mixture of the liquid crystal and the resin raw material, and the polymerization and phase-separation are simultaneously effected on all the regions. Alternatively, the following method may be employed. Three pairs of substrates each provided with the electrode layer only on one side may be employed. The spaces between the paired substrates are filled with the mixture of the liquid crystal and the resin raw material, and the polymerization and phase-separation are effected on the mixtures, and thereafter the substrate pairs are adhered together with adhesive so that the liquid crystal display element shown in FIG. 1 can be completed.

In the foregoing method, the liquid crystal display layer is prepared by curing the resin raw material by the photo-polymerization phase-separation method. Alternatively, the liquid crystal display layer may be formed by arranging column-like or dam-like resin structures in the image display regions in accordance with a predetermined arrangement pattern. For example, the following method may be employed for providing the liquid crystal display layer. Resin (e.g., polymethylsilane of molecular weight of 10000 or more) is dissolved in organic solvent (e.g., dichlormethane) or the like. The resin solvent thus prepared is applied to the surface of the substrate (e.g., a glass substrate) carrying the transparent electrode (made of, e.g., an ITO film), and is dried to form the resin film of, e.g., 10 $\mu$m in thickness. Thereafter, ultraviolet light (e.g., light of a mercury lamp of 250 W) or the like is emitted through a mask having a predetermined (e.g., cellular) mask pattern to the portion to be irradiated with light. Thereby, the portion becomes dissolvable. The dissolvable portion thus prepared is removed by washing with, e.g., organic solvent such as isopropyl alcohol so that the resin walls corresponding to the mask configuration are formed. Then, the liquid crystal material, which is formed of, e.g., nematic liquid crystal MN1000XX and chiral dopant S811 added at 30.6% by weight thereto for providing the selective reflection wavelength of 550 nm (green region), is applied to the spaces between the above region walls. The spaces thus filled with the liquid crystal are covered and sealed with the transparent substrate provided with the transparent electrodes so that the liquid crystal panel which can perform the green display is completed. Likewise, the liquid crystal panels capable of blue display and red display are prepared. These panels may be fixed together with transparent adhesive.

According to the above manner, the resin walls can be formed in the predetermined positions. Therefore, the resin walls having a high numerical aperture can be formed, and the liquid crystal display element capable of high-contrast display can be formed. Further, the liquid crystal regions can have uniform configurations, and can be accurately positioned so that the drive voltages for the respective liquid crystal regions in the liquid crystal display element thus produced can be uniform, and therefore the drive voltage required for the whole liquid crystal display element can be lowered. In the liquid crystal display element thus produced, the liquid crystal is not present within the resin wall of the display layer. Accordingly, such a situation can be avoided that the liquid crystal within the resin disperses the incident light, and therefore the contrast is improved.

The liquid crystal display layer may be formed in the following method. After forming the resin walls of the configurations corresponding to the masks in the manner similar to the above, the mixture of liquid crystal material and resin raw material, which are 8:2 in weight ratio, is applied to the spaces between the resin walls. The liquid crystal material in this mixture is, e.g., nematic liquid crystal MN1000XX and chiral dopant S811 added at 30.6% by weight thereto for providing the selective reflection wavelength of 550 nm. The resin raw material in the above mixture is, e.g., a mixture of monofunctional acrylate monomers R128H having an aromatic ring and polymerization initiator IRGACURE 184 at 3% by weight. The spaces thus filled with the mixture is covered with the transparent substrate provided with the transparent electrodes, and ultraviolet rays are emitted thereto, e.g., at a rate of 0.02 mW/cm$^2$ for one hour, and thereafter are emitted thereto at 0.25 mW/cm$^2$ for one hour so that the polymerization occurs in the resin raw material to cause the phase separation.

The structure of the liquid crystal display element may not use the foregoing resin material such as resin structural member and resin matrix prepared by the polymerization and phase-separation, but may have, e.g., a structure wherein cholesteric liquid crystal material is directly held between the paired substrates without using the foregoing resin material or the like.

In each of the color display layers 31, 32 and 33, a pigment may be added for absorbing light component, which may lower the color purity in color display performed by selective reflection and may lower the transparency in the transparent state. Alternatively, a colored filter such as a colored glass filter or a colored film may be arranged for achieving the same or similar effect.

The pigment may be added to any one of the liquid crystal material, resin, transparent electrode and transparent substrate forming the liquid crystal display element, and may also be added to two or more of them. The colored filter layer may be arranged on either the outer or inner side of the substrate. In any one of the above structures, it is desired for avoiding lowering of the display quality that the pigment and the filter are arranged without impeding original color display performance of the liquid crystal in the respective color display layers.

Figure 2:
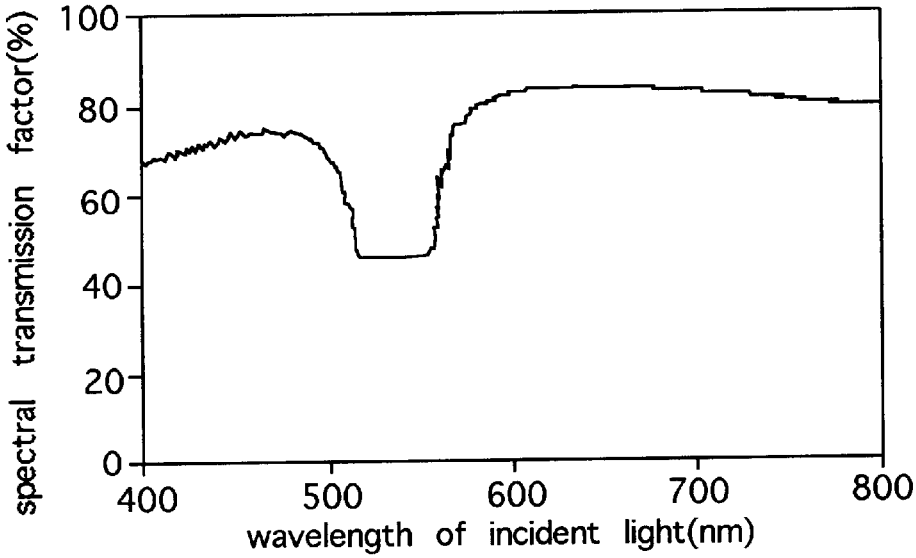
FIG. 2 shows an example of a relationship between a wavelength of incident rays and a transmission factor in a liquid crystal display layer which includes liquid crystal material having a selective reflection wavelength in a green range.

FIG. 2 shows an example of a spectral transmission factor of the liquid crystal display layer which includes the liquid crystal material having the selective reflection wavelength in the green region. In FIG. 2, the abscissa gives the wavelength of the incident light, and the ordinate gives the transmission factor of the incident light. According to FIG. 2, the transmission factor of the light of the wavelength around 550 nm is low because the display layer, which is the green display layer, selectively reflects the light of the wavelength around 550 nm. The transmission factor in the wavelength range shorter than about 550 nm is lower than that in the wavelength range longer than about 550 nm. According to the study by the inventors of the invention and others, the reason for this can be considered that the light of the wavelength longer than the selective reflection wavelength of the liquid crystal can easily pass through the liquid crystal display layer, and the light of the wavelengths shorter than the selective reflection wavelength of the liquid crystal is more liable to be scattered in the liquid crystal display layer with reduction in wavelength. Accordingly, when the display is performed by the liquid crystal which has the selective reflection wavelength on the longer wavelength side such as the red side, scattered blue light or the like may lower the color purity of red. Also, the reflection factor of black displayed in the transparent state increases, and thereby the contrast lowers.

Accordingly, it is preferable or desired that the light absorbing material such as a pigment added to the red display layer or a colored filter arranged for the red display layer can absorb blue light and others, whereby the color purity and contrast in red are improved, and the display quality can be effectively improved. In the green and blue display layers, addition of the pigment or the like can improve the color purity in color display of the selective reflection wavelength to a less extent than the case in the red display layer, but can improve the contrast to the substantially same extent as that in the red display layer. As described above, scattering of the light of the wavelengths shorter than the selective reflection wavelength may primarily lower the display quality. Therefore, it is preferable to use in each display layer the pigment which can absorb the spectrum light in the wavelength range shorter than the selective reflection wavelength of the liquid crystal in the color display layer.

The pigment may be selected from various known kinds of pigment. For example, various kinds of dye such as a pigment for coloring resin and a dichromatic pigment for liquid crystal display may be used. More specifically, the pigment for coloring the resin may be SPR-Redl, SPR-Yellowl (both manufactured by Mitsui Toatsu Senryo Co., Ltd.) or the like may be used. The dichromatic pigment for liquid crystal display may be SI-426, M-483 (both manufactured by Mitsui Toatsu Senryo Co., Ltd.) or the like.

The amount of added pigment is not particularly restricted provided that the addition does not remarkably impede the characteristics of operation of switching the display state, and provide that the addition does not impede the polymerization when the liquid crystal display layer includes the resin and is prepared by polymerization and phase-separation. However, the addition rate with respect to the whole liquid crystal display layer is preferably 0.1% by weight or more. The rate of about 1% by weight is enough to achieve the intended effects.

In the case where the colored filter is used instead of addition of the pigment, such filters may be selectively used that the foregoing pigment is added to a colorless transparent filter, that the filter is made of an originally colored material, and that the film made of a material which has the substantially same function as the foregoing pigment is formed on the substrate or the like. More specifically, the colored filter layer hay be selected from Wratten gelatine filter Nos. 8 and 25 (both manufactured by Eastman Kodak Co., Ltd.), commercially available color glass filters and others. Instead of the colored filter layers, the transparent substrates 11, 12 and 13 on the observer side may be formed of the above colored filters, respectively, whereby similar effects can be achieved.

Since the light in the wavelength range shorter than the selective reflection wavelength of the liquid crystal is scattered to a higher extent, it can be understood that the blue, green and red display layers are arranged in this order from the observer side, as is done in the liquid crystal display element A. This is because the arrangement of the display layer, which can selectively reflect the light of a shorter wavelength, in the position nearer to the observer increases the light passing toward the observer (i.e., toward the layer remote from the light reflecting side) and therefore can perform more bright display.

Figure 16:
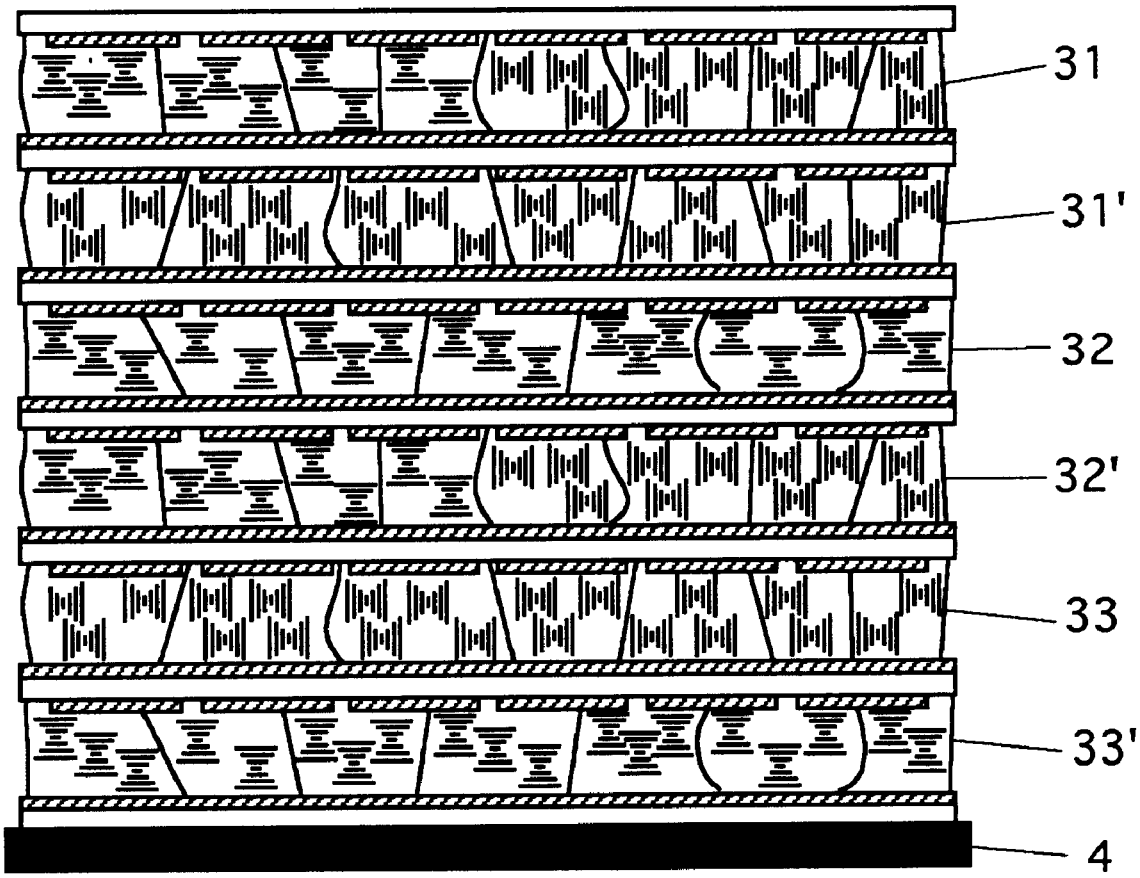
FIG. 16 shows a schematic structure of another example of the liquid crystal display element in the liquid crystal display device according to the invention.

The selective reflection of the cholesteric liquid crystal decomposes the linearly polarized light of the incident light into right or left circularly polarized components, and reflects one of them while allowing passage of the other. Accordingly, each of the display layers 31, 32 and 33 in the display device shown in FIG. 1 has the light utilizing efficiency of up to 50%. As shown in FIG. 16, therefore, the liquid crystal display element in the display device shown in FIG. 1 is additionally provided with a blue display layer 31' which has the same selective reflection wavelength as the liquid crystal of the blue display layer 31, and has the spiraling direction opposite to that of the liquid crystal of the blue display layer 31, a green display layer 32' which has the same selective reflection wavelength as the liquid crystal of the green display layer 32, and has the spiraling direction opposite to that of the liquid crystal of the green display layer 32, and a red display layer 33' which has the same selective reflection wavelength as the liquid crystal of the red display layer 33, and has the spiraling direction opposite to that of the liquid crystal of the red display layer 33. Thus, the liquid crystal display element is formed of the display layers of six in total number. Thereby, the liquid crystal display element can perform more bright display. In this liquid crystal display element, the display layers, which can reflect the light rays of the same color and the opposite optical rotations, are driven individually, whereby the resolution of the reproducible intermediate color can be improved. The layering order of the respective display layers is not restricted, but the blue display layer 31, blue display layer 31' of the opposite optical rotation, green display layer 32, green display layer 32' of the opposite optical rotation, red display layer 33 and red display layer 33' of the opposite optical rotation are preferably arranged in this order from the observer side in view of the spectral transmission characteristics already described. Thereby, high-quality display can be performed.

In the display device shown in FIG. 1, when predetermined voltages are applied across the scanning and signal electrodes 22 and 21, across the scanning and signal electrodes 24 and 23, and across the scanning and signal electrodes 26 and 25 to set the liquid crystal in all the display layers to the focal conic state, the liquid crystal in all the display layers becomes transparent, and the black background is displayed. When the liquid crystal in all the display layers is in the planar state, the liquid crystal in each display layer reflects the light of the color of the selective reflection wavelength thereof so that display in white is performed. When the liquid crystal in one of the display layers is in the planar state, and the liquid crystal in the other two layers is in the focal conic state, display in blue, green or red is performed. When the liquid crystal in only one of the display layers is in the focal conic state, and the liquid crystal in the other two layers is in the planar state, display in cyan, magenta or yellow is performed. Based on combinations of the above manners, display in multiple (i.e., eight) colors can be performed. Further, as will be described later, the intermediate selective reflection state can be selected in each liquid crystal display layer, and therefore display in intermediate colors can be performed so that full-color display can be performed as a whole.

Although the description has been given on the liquid crystal display element for multiple color display formed of the three liquid crystal display layers, the liquid crystal display element forming the display device according to the invention may be a liquid crystal display element for monocolor display formed of a single liquid crystal display layer.

(II-2) The drive circuit B of the display device in FIG. 1 will now be described with reference to FIGS. 3(A) and 3(B).

Figure 3A:
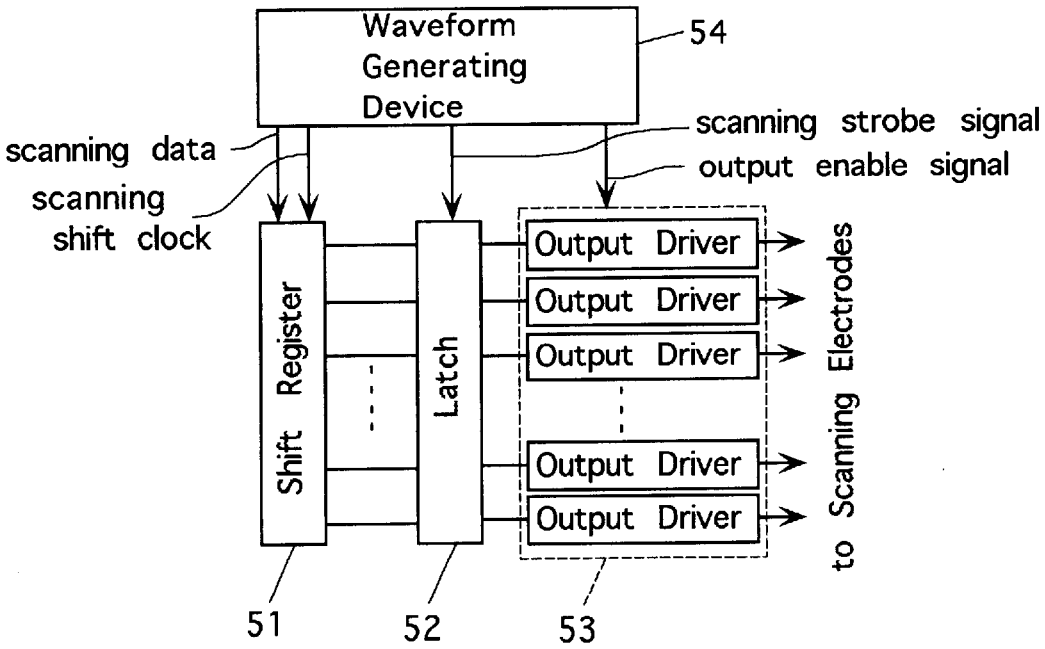
FIG. 3(A) is a schematic block diagram showing an example of a scanning electrode drive circuit provided in the liquid crystal display device shown in FIG. 1.
Figure 3B:
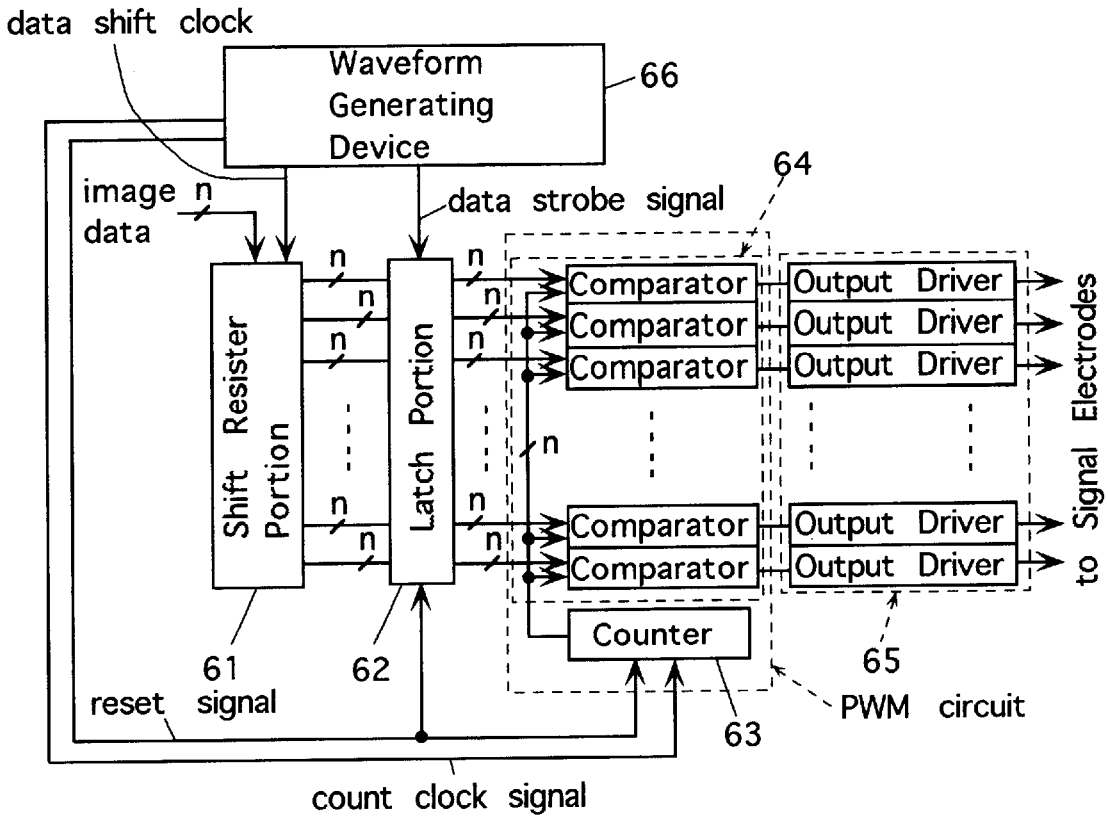
FIG. 3(B) is a schematic block diagram showing an example of a signal electrode drive circuit provided in the liquid crystal display device shown in FIG. 1.

The drive circuit B is formed of a scanning electrode drive circuit shown in FIG. 3(A) and a signal electrode drive circuit shown in FIG. 3(B).

The scanning electrode drive circuit has a shift register 51, a latch 52 and an output driver portion 53 as shown in FIG. 3(A).

The output driver portion 53 is formed of a plurality of output drivers which are connected to the scanning electrodes (scanning lines) in the liquid crystal display element A shown in FIG. 1, respectively. Each output driver receives a corresponding latch output. When the input of the output driver sent from the latch 52 is on, the output driver issues a voltage corresponding to an output enable signal sent from a waveform generating device 54. When the input of the output driver sent from the latch 52 is off, the output of the output driver is off. The latch 52 latches each output of the shift register 51 in synchronization with the rising edge of a scanning strobe signal sent from the waveform generating circuit 54. The latch 52 sends the latched data to each output driver.

The scanning can be performed in the following manner. In accordance with the scanning data and the scanning shift clock sent from the waveform generating device 54, only one of the outputs of the shift register 51 is turned on, and the outputs of the shift register 51 to be turned on are successively changed in synchronization with the scanning shift clock. The latch 52 latches the outputs of the shift register 51 in synchronization with the scanning strobe signal. Thereby, only one of the outputs of the latch 52 is turned on, and the outputs of the latch 52 in the ON state successively changes. The output driver supplied with the ON signal from the latch 52 enters the selected state, and issues the voltage corresponding to the output enable signal to the corresponding scanning electrode. By using, e.g., a pulse signal as the output enable signal, the pulse voltage can be applied to the selected scanning electrodes. In the above operation, the output enable signal controls the pulse width of the pulse voltage applied to the scanning electrode as well as the timing of voltage application and others. Since the output drivers are successively selected one by one, the voltage corresponding to the output enable signal can be successively applied to the respective scanning electrodes.

As shown in FIG. 3(B), the signal electrode drive circuit has a shift register portion 61, a latch portion 62, a counter 63, a comparator portion 64 and an output driver portion 65. The counter 63 and the comparator portion 64 form a PWM circuit.

The output driver portion 65 has a plurality of output drivers connected to the signal electrodes (signal lines) of the liquid crystal display element A in FIG. 1, respectively. The comparator portion 64 has a plurality of comparators connected to the output drivers, respectively. Each comparator is a magnitude comparator (digital comparator) of n bits. The latch portion 62 has a plurality of latches (not shown) connected to the comparators, respectively. Each latch can latch a data of n bits in synchronization with a data strobe signal sent from a waveform generating device 66. The shift register portion 61 has a plurality of n-bit shift registers (not shown) connected to the latches, respectively. The respective shift registers can be successively supplied with image data (tone data or gradation level data) of the drive target pixels in synchronization with the data shift clock. Each shift register is supplied with the image data (tone data) of n bits, where n is an integer larger than 1. The image data is supplied to the shift register portion 61 from a memory (not shown).

In the following manner, the signal electrode drive circuit can apply to the respective signal electrodes the pulse voltages, which have on-timing changing in accordance with the image data, and all have uniform OFF-timing.

The image data supplied to each shift register is latched by the corresponding latch in synchronization with the data strobe signal.

In response to a releasing of the reset signal, the counter 63 starts count-up from 0. The counter 63 performs the count-up in synchronization with the count clock signal. The count of the counter 63 is sent to each comparator.

Each comparator compares the count value sent from the counter 63 with the image data (tone data) sent from the latch. Each comparator issues the OFF signal when the count value does not exceed the image data, and issues the ON signal when the count value exceeds the image data.

According to the above structure and manners, the on-timing of the signal sent from each output driver changes in accordance with the tone data (tone level) of the drive target pixel. Thereafter, the waveform generating device 66 sends the reset signal to the latches and the counter 63, whereby all the signals issued from the respective drivers can have the same off-timing. The shift operation of supplying the image data to the shift registers and the counting operation are performed via the latch portion 62, and therefore can be performed simultaneously. Therefore, each output driver can issue the signal, and simultaneously the image data on the next signal line can be supplied to the shift register portion 61.

In the above liquid crystal display element A, the drive circuit B executes the line-sequential matrix driving on the respective liquid crystal display layers. A potential difference corresponding to the difference, which occurs between the voltage applied to the scanning electrode and the voltage applied to the signal electrode, occurs in the position corresponding to the crossing (pixel) between the scanning electrode and the signal electrode in each liquid crystal display layer. In accordance with this potential difference and the time of voltage application, each pixel is selectively set to the transparent state, selective reflection state and intermediate state, and the image can be displayed in multiple levels as a whole.

(II-3) Referring to FIG. 4, description will now be given on an example of a method of performing display in intended tone levels on a predetermined pixel in the liquid crystal display element of the liquid crystal display device shown in FIG. 1.

Figure 4:
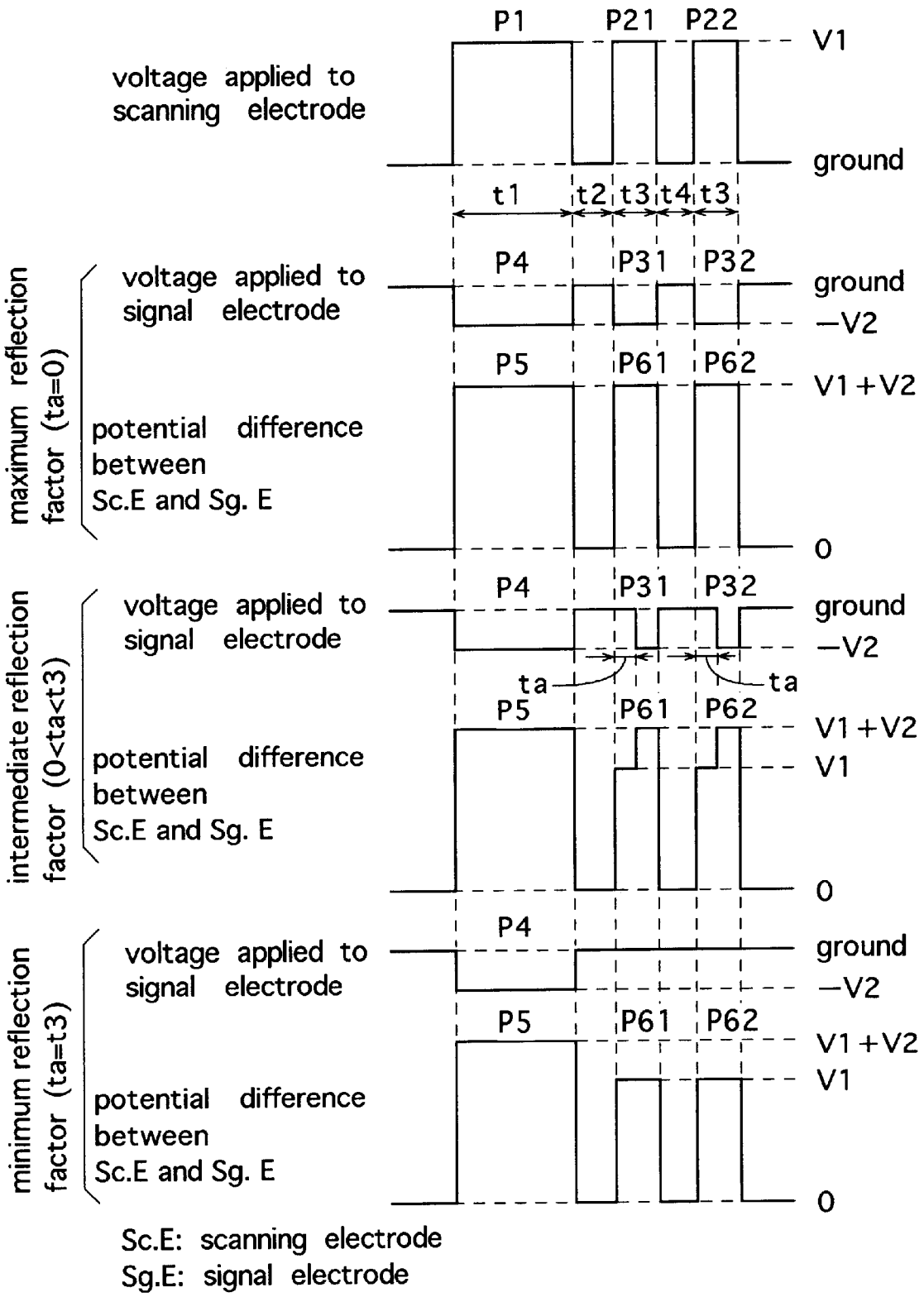
FIG. 4 shows an example of patterns of drive voltages which are applied to the scanning electrode and the signal electrode in a method of driving the liquid crystal display element according to the invention.

FIG. 4 shows a relationship between the voltages applied to the scanning and signal electrodes corresponding to the drive target pixel and the potential difference between the scanning and signal electrodes. More specifically, FIG. 4 shows the above relationship in such cases that the reflection factor of the drive target pixel is maximum, minimum and intermediate the maximum and minimum values, respectively.

In any one of the cases where the reflection factor of the drive target pixel takes on the maximum, minimum and intermediate values, respectively, the scanning electrode is supplied with a first pulse voltage P1 and a second pulse voltage formed of two pulse voltages P21 and P22 in the following manner.

The scanning electrode is supplied with the first pulse voltage P1 having a pulse width of t1 and a magnitude of V1, a pulse voltage P21 which has a pulse width of t3 and a magnitude of V1, and is delayed by a time interval of t2 from the first pulse voltage P1, and a pulse voltage P22 which has a pulse width of t3 and a magnitude of V1, and is delayed by a time interval of t4 from the pulse P21.

The signal electrode is supplied with the pulse voltages in the following manner. In any one of the cases where the reflection factor takes on the maximum, minimum and intermediate values, the signal electrode is first supplied with a fourth pulse voltage P4 of a pulse width of t1 and a magnitude of −V2 in synchronization with the first pulse voltage P1. The on-timing and off-timing of the fourth pulse voltage P4 are coincident with those of the first pulse voltage P1. The polarity of the fourth pulse voltage P4 in this example is opposite to that of the first pulse voltage P1. After receiving the fourth pulse voltage P4, the signal electrode is further supplied with a third pulse voltage formed of two pulse voltages P31 and P32 having the same magnitude of −V2.

The on-timing of the pulse voltages P31 and P32 is delayed by a time ta from the on-timing of the respective pulse voltages P21 and P22 in accordance with the tone level of the drive target pixel. The off-timing of the pulse voltages P31 and P32 is always determined to be coincident with the off-timing of the respective pulse voltages P21 and P22, independently of the tone level of the drive target pixel.

When the reflection factor of the drive target pixel is to be maximum, ta is set to 0. Thereby, the signal electrode is supplied with the pulse voltages P31 and P32 of the pulse widths of t3. The on-timing and off-timing of the pulse voltage P31 are coincident with those of the pulse voltage P21. The on-timing and off-timing of the pulse voltage P32 are coincident with those of the pulse voltage P22.

When the reflection factor of the drive target pixel is to be of the intermediate value, the on-timing of the pulse voltages P31 and P32 is delayed from the on-timing of the respective pulse voltages P21 and P22 by the time ta, which is between 0 and t3 ($0<ta<t3$).

When the reflection factor of the drive target pixel is to be minimum, the time ta is set to t3 ($ta=t3$). Thereby, the pulse voltages P31 and P32 have the pulse widths of 0. In this case, the signal electrode is supplied with the pulse voltages P31 and P32 of the pulse widths of 0 after receiving the fourth pulse voltage P4.

Thereby, as shown in FIG. 4, the liquid crystal material of the drive target pixel is first supplied with a pulse voltage P5 of the pulse width of t1 and the magnitude of (V1+V2). After the time interval of t2, the liquid crystal of the drive target pixel is supplied with a pulse voltage P61 of a pulse width of t3 and a pulse voltage P62 of a pulse width of t3 delayed from the pulse voltage P61 by a time interval of t4.

When the reflection factor of the drive target pixel is to be maximum, the magnitude of each of pulse voltages P61 and P62 is (V1+V2).

When the reflection factor of the drive target pixel is to be intermediate the maximum and minimum values, each of the pulse voltages P61 and P62 is formed of two portions, i.e., a portion having a pulse width of ta and a magnitude of V1, and a portion having a pulse width of (t3−ta) and a magnitude of (V1+V2).

When the reflection factor of the drive target pixel is to be minimum, the pulse voltages P61 and P62 have the magnitudes of V1.

As described above, the on-timing for applying the third pulse voltage (pulse voltages P31 and P32) to the signal electrode is delayed from the on-timing for applying the second pulse voltage (pulse voltages P21 and P22) to the scanning electrode by the time of ta corresponding to the intended display tone level of the drive target pixel, whereby the pulse widths of the third pulse voltages P31 and P32 applied to the signal electrode are changed from zero to the value equal to the pulse widths of the second pulse voltages P21 and p22. Thereby, the pulse voltages P61 and P62 applied to the liquid crystal layer are changed in magnitude.

The pulse voltage P5 has the magnitude and width which can set the liquid crystal in the display layer to the homeotropic state. The high and low voltage portions of each of the pulse voltages P61 and P62 are determined such that these portions can set the liquid crystal to the homeotropic state again or incomplete homeotropic state after stop of application of the pulse voltage P5. More specifically, the length of time of ta is controlled in accordance with the required display tone level of the drive target pixel, whereby the width of each voltage portion of the pulse voltages P61 and P62 applied to the liquid crystal of the drive target pixel is controlled so that the liquid crystal of the drive target pixel is selectively set to the planar state, focal conic state and an intended intermediate state. By effecting the above operation on each pixel, the liquid crystal display element selectively attains the states of the highest reflection factor and lowest reflection factor as well as the intermediate state, and thereby displays the image in multiple tone levels.

By the application of the fourth pulse voltage, the pulse voltage applied to the liquid crystal of the drive target pixel for setting the liquid crystal to the homeotropic state may have the magnitude increased by V2. When the liquid crystal display layer can be set to the homeotropic state only by applying the first pulse voltage to the scanning electrode, application of the fourth pulse voltage may be eliminated.

In this manner, the on-timing and/or off-timing of the third pulse voltage are controlled with respect to the on-timing and/or off-timing of the second pulse voltage so that the pulse width of the third pulse voltage is changed from zero to at least the pulse width of the second pulse voltage in accordance with the required display tone level of the drive target pixel. Thereby, the intermediate state can be selected from an entire range between the state of the attainable maximum reflection factor (i.e., planar state) and the state of the attainable minimum reflection factor (i.e., focal conic state) of the liquid crystal display element. In particular, it is desired that display tone level can be selected from wide range in the liquid crystal display device for full-color image display. Therefore, the above driving manner is effective in the liquid crystal display device for full-color display to be controlled in a wide range.

(II-4) Description will now be given on an experimental example 1 which was performed with an experimental display device. This experimental display device has a same structure as that of the display device shown in FIG. 1 except that the experimental display device has only one liquid crystal display layer. In a specific experimental example 1 described below, the pulse voltage was applied to the predetermined pixel in accordance with the pattern shown in FIG. 4. Measurement of the transmission factor was performed by measuring the spectral reflection factor (Y-value) with a reflective spectrophotometric calorimeter CM-1000 (manufactured by Minolta Co., Ltd.) having a white light source. A smaller Y-value means a high transparency.

The liquid crystal display layer was formed of the liquid crystal material exhibiting the cholesteric characteristic and the resin mixed at a weight ratio of 8:2. The liquid crystal exhibiting the cholesteric characteristic was prepared by adding the chiral dopant S811 to the mixture of nematic liquid crystal materials NM1000XX and ZLI1565 so that the liquid crystal material has the adjusted selective reflection wavelength of 550 nm. The resin raw material was a mixture of adamantile methacrylate and 20 weight % of BF530.

Figure 5:
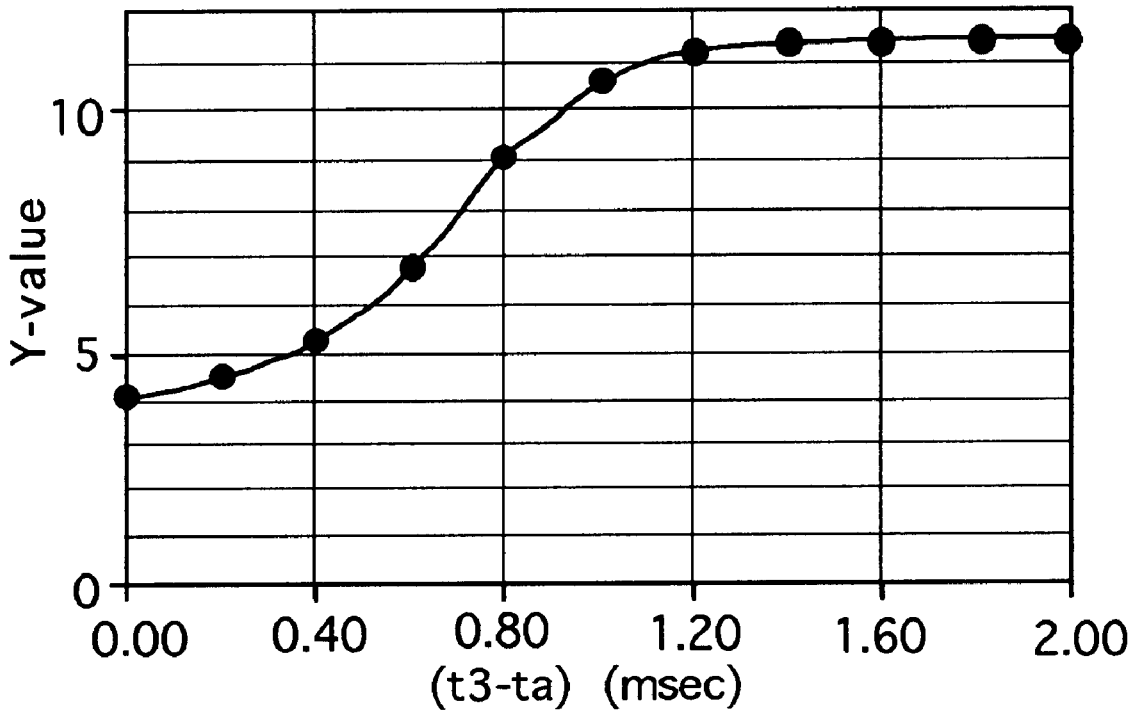
FIG. 5 shows an example of a relationship between a spectral reflection factor of the liquid crystal display element and a pulse width of a third pulse voltage in the case where voltages are applied to the liquid crystal display element in accordance with the drive pattern shown in FIG. 4.

The voltages were applied under the conditions of V1=140 V, V2=30 V, t1=5 msec (milliseconds), t2=2 msec, t3=2 msec and t4=2 msec. The pulse width (t3−ta) of the third pulse voltage applied to the signal electrode was changed in a range from 0 to 2 msec. FIG. 5 shows a relationship between the pulse widths (t3−ta) of the pulse voltages P31 and P32 forming the third pulse voltage and the spectral reflection factor (Y-value) of the liquid crystal display element. If the pulse width of the pulse voltage was equal to or larger than 1.1 msec, the Y-value takes on the approximately constant value of 11. In the range where the pulse width is lower than 1.1 msec, the Y-value was continuously variable between 4 and 11. As described above, by shifting the on-timing of the third pulse voltage applied to the signal electrode, and thereby changing the pulse width, the display state of the liquid crystal display element can be continuously changed, as can be understood from the above.

For providing the simple and inexpensive structure of the drive circuit, the above example employs the first pulse voltage P1 and the second pulse voltage P2 (pulse voltages P21 and P22) of the same magnitude of V1 as well as the fourth pulse voltage P4 and the third pulse voltage P3 (pulse voltages P31 and P32) of the same magnitude of −V2. However, the first and second pulse voltages P1 and P2 may have different magnitudes, respectively, and/or the third and fourth pulse voltages may have different magnitudes, respectively. In the above example, the pulse voltages P21 and P22 forming the second pulse voltage have the same pulse width of t3, but may have different pulse widths. In the above example, the on-timing of the pulse voltages P31 and P32 is delayed by the same time of ta from the on-timing of the respective pulse voltages P21 and P22, but may be delayed by different times. In the above example, each of the first and fourth pulse voltages is formed of the single pulse voltage, and each of the second and third pulse voltages is formed of the two pulse voltages. However, each of them may be formed of one or more pulse voltage(s).

(II-5) Referring to FIGS. 6 to 8, description will now be given on other examples of patterns of the drive voltages applied to the scanning electrode and the signal electrode.

Figure 6:
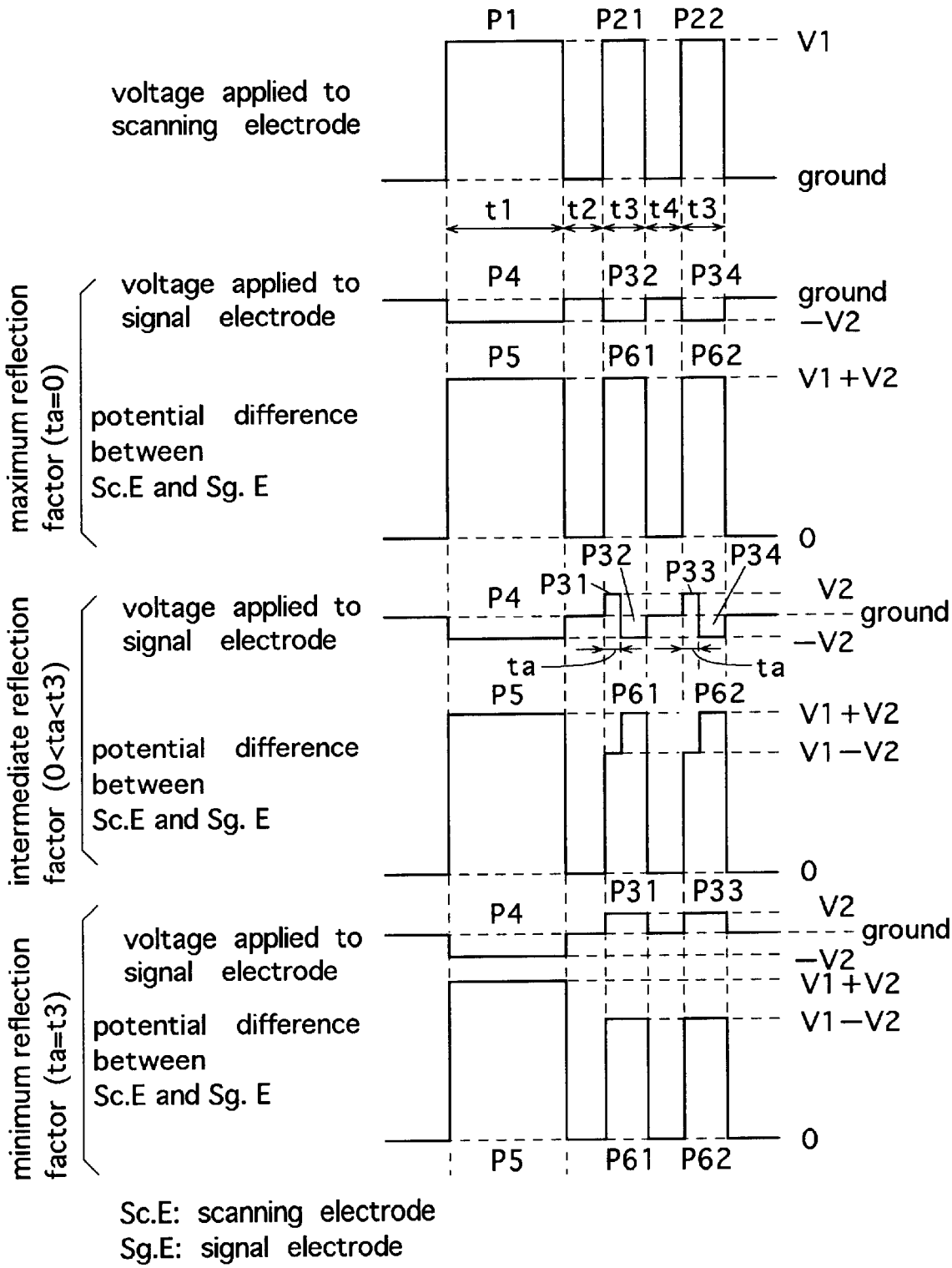
FIG. 6 shows another example of patterns of the drive voltages which are applied to the scanning electrode and the signal electrode in the method of driving the liquid crystal display element according to the invention.

(II-5-1) In the drive pattern shown in FIG. 6, the scanning electrode is supplied with the first pulse voltage P1 and the second pulse voltage formed of the pulse voltages P21 and P22 in accordance with the same drive pattern as that shown in FIG. 4.

The signal electrode is supplied with the pulse voltages in the following manner in accordance with the intended display tone of the drive target pixel.

First, description will be given on the case where the reflection factor of the drive target pixel is to be set to the intermediate state. First, the signal electrode is supplied with the fourth pulse voltage P4 of the pulse width of t1 and the magnitude of −V2 in accordance with the same timing as the first pulse voltage P1. In this example, the fourth pulse voltage P4 has the polarity opposite to that of the first pulse voltage P1. After the time t2, the third pulse voltage formed of pulse voltages P31, P32, P33 and P34 is applied in the following manner. Each of the pulse voltages P31 and P33 has a pulse width of ta and a magnitude of V2. Each of the pulse voltages P32 and P34 has a pulse width of (t3−ta) and a magnitude of −V2. The pulse voltages P31 and P32 are applied with a pulse interval of 0. The pulse voltages P32 and P33 are applied with a pulse interval of t4. The pulse voltages P33 and P34 are applied with a pulse interval of 0. By changing the time ta in accordance with the intended display tone level of the drive target pixel, the pulse width of each of the pulse voltages P31, P32, P33 and P34 is changed.

When the reflection factor of the drive target pixel is to be maximum, the time ta is set to 0. Thereby, the signal electrode is supplied with the pulse voltage P31 of the pulse width of 0, the pulse voltage P32 of the pulse width of t3, the pulse voltage P33 of the pulse width of 0 and the pulse voltage P34 of the pulse width of t3.

When the reflection factor of the drive target pixel is to be minimum, the time ta is set to t3. Thereby, the signal electrode is supplied with the pulse voltage P31 of the pulse width of t3, the pulse voltage P32 of the pulse width of 0, the pulse voltage P33 of the pulse width of t3, and the pulse voltage P34 of the pulse width of 0.

By applying the voltages to the scanning and signal electrodes in accordance with the patterns shown in FIG. 6, the pulse voltages P61 and P62 having the magnitudes corresponding to the intended display tone level of the drive target pixel can be applied to the liquid crystal of the drive target pixel.

Figure 7:
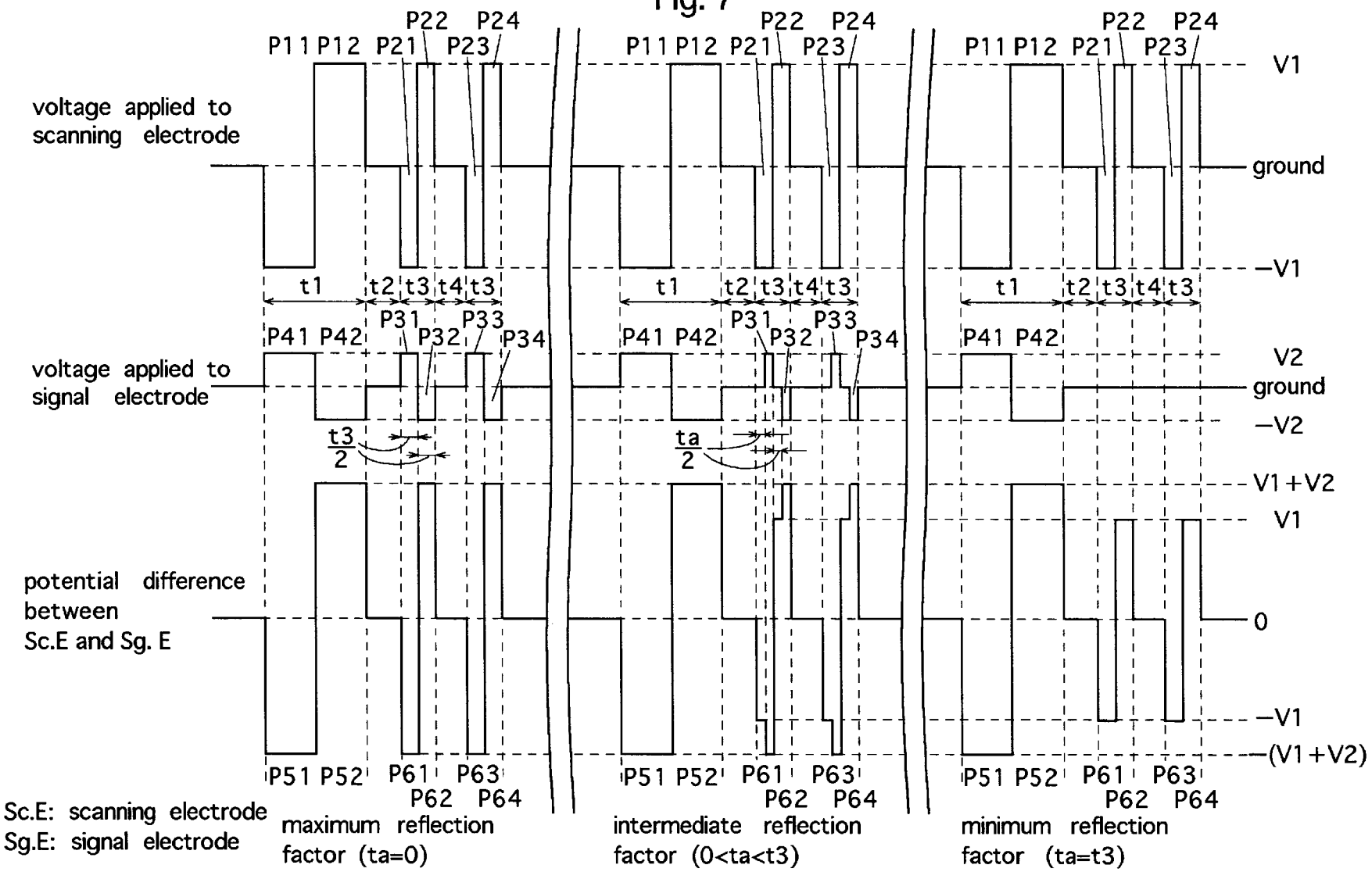
FIG. 7 shows still another example of patterns of drive voltages which are applied to the scanning electrode and the signal electrode in the method of driving the liquid crystal display element according to the invention.

(II-5-2) In the drive pattern shown in FIG. 7, the scanning electrode is supplied with the first pulse voltage formed of the two pulse voltages P11 and P12 as well as the second pulse voltage formed of four pulse voltages P21, P22, P23 and P24. The pulse voltage P11 has a pulse width of t1/2 and a magnitude of −V1. The pulse voltage P12 has a pulse width of t1/2 and a magnitude of V1. The pulse voltages P11 and P12 are applied with a pulse interval of 0. Each of the pulse voltages P21 and P23 has a pulse width of t3/2 and a magnitude of −V1. Each of the pulse voltages P22 and P24 has a pulse width of t3/2 and a magnitude of V1. The pulse voltages P21 and P22 are applied with a pulse interval of 0. The pulse voltages P23 and P24 are applied with a pulse interval of 0. The pulse voltages P22 and P23 are applied with a pulse interval of t4.

The signal electrode is supplied with the pulse voltages in the following manner in accordance with the intended display tone level of the drive target pixel.

Description will now be given on the case where the reflection factor of the drive target pixel is to be set to the intermediate state. The signal electrode is first supplied with the fourth pulse voltage formed of two pulse voltages P41 and P42. The pulse voltage P41 has a pulse width of t1/2 and a magnitude of V2. The pulse voltage P42 has a pulse width of t1/2 and a magnitude of −V2. The pulse voltage P41 in this example has the polarity. opposite to that of the pulse voltage P11. The pulse voltages P41 and P42 are applied with a pulse interval of 0. The pulse voltages P41 and P42 are applied in accordance with the same timing as the pulse voltages P11 and P12.

After application of the fourth pulse voltage, the signal electrode is further supplied with the third pulse voltage formed of the four pulse voltages P31, P32, P33 and P34. Each of the pulse voltages P31 and P33 has a pulse width of (t3−ta)/2 and a magnitude of V2. Each of the pulse voltages P32 and P34 has a pulse width of (t3−ta)/2 and a magnitude of −V2. The pulse voltages P31, P32, P33 and P34 are applied in accordance with the timing delayed by ta/2 from the on-timing of the pulse voltages P21, P22, P23 and P24, respectively. By changing the time ta in accordance with the intended display tone level of the drive target pixel, the pulse widths of the pulse voltages P31, P32, P33 and P34 are changed.

When the reflection factor of the drive target pixel is to be maximum, the time ta is set to 0. Thereby, the signal electrode is supplied with the pulse voltages P31, P32, P33 and P34 each having the pulse width of t3/2.

When the reflection factor of the drive target pixel is to be minimum, the time ta is set to t3. Thereby, the signal electrode is supplied with the pulse voltages P31, P32, P33 and P34 each having the pulse width of 0.

By applying the voltages to the scanning and signal electrodes in accordance with the drive voltage patterns shown in FIG. 7, the liquid crystal in the drive target pixel is first supplied with pulse voltages P51 and P52 of different polarities. Thereafter, the liquid crystal in the drive target pixel can be supplied with pulse voltages P61, P62, P63 and P64 having the magnitudes corresponding to the intended display tone level of the drive target pixel. In this manner, the pulse voltages of the opposite polarities are successively applied to the liquid crystal in the drive target pixel, whereby the stable drive can be performed for a long term.

Figure 8:
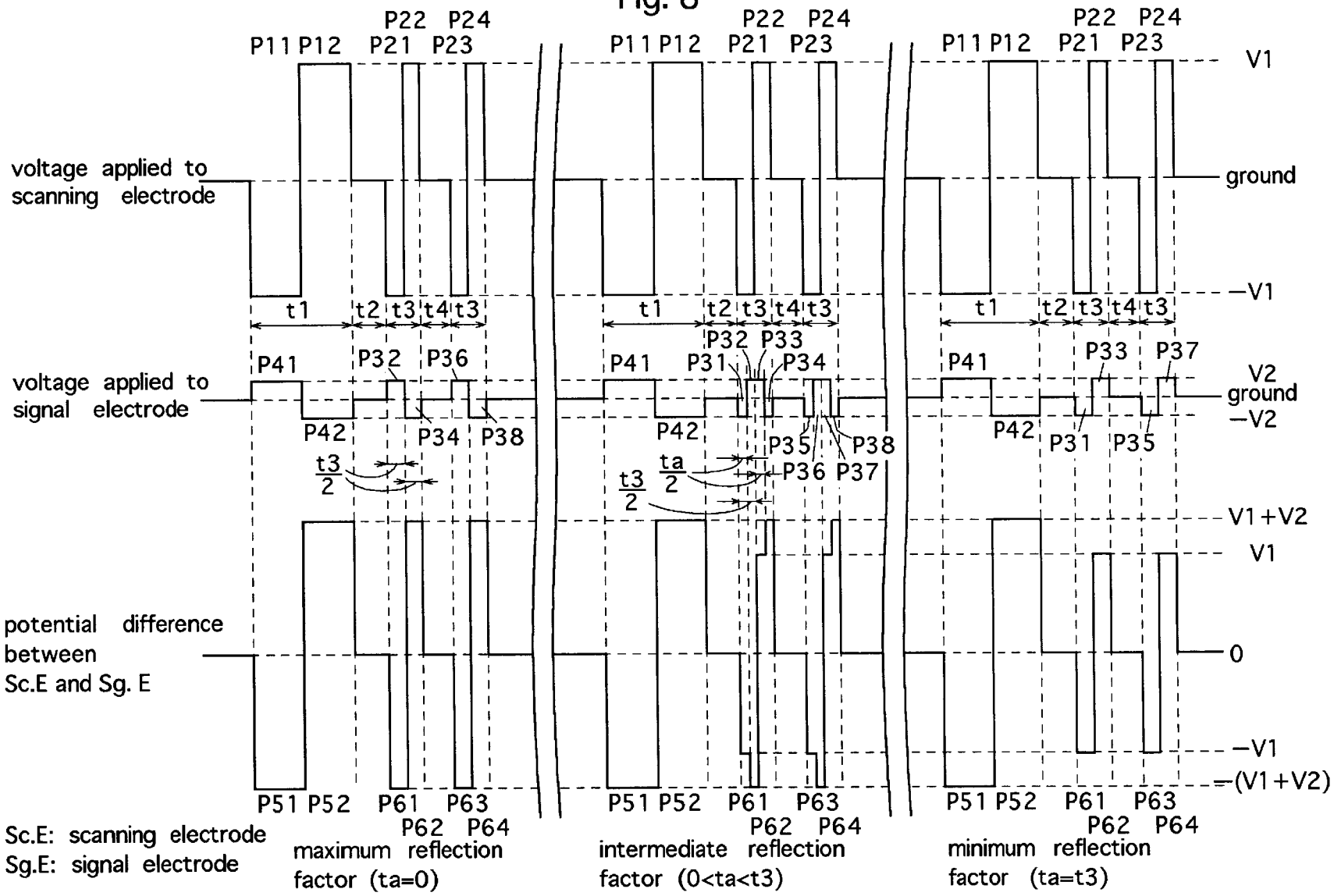
FIG. 8 shows yet another example of patterns of drive voltages which are applied to the scanning electrode and the signal electrode in the method of driving the liquid crystal display element according to the invention.

(II-5-3) In drive patterns shown in FIG. 8, the scanning electrode is supplied with the first pulse voltage formed of the two pulse voltages P11 and P12 as well as the second pulse voltage formed of the four pulse voltages P21–P24 in accordance with the same drive pattern as the drive pattern shown in FIG. 7.

The signal electrode is supplied with the pulse voltages in the following manner in accordance with the required display tone of the drive target pixel.

Description will now be given on the case where the reflection factor of the drive target pixel is to be set to the intermediate state. First, the signal electrode is supplied with the fourth pulse voltage formed of the two pulse voltages P41 and P42. The pulse voltage P41 has a pulse width of t1/2 and a magnitude of V2. The pulse voltage P41 has the polarity opposite to that of pulse voltage P11. The pulse voltage P42 has a pulse width of t1/2 and a magnitude of −V2. The pulse voltages P41 and P42 are applied with a pulse interval of 0. The pulse voltages P41 and P42 are applied in accordance with the same timing as the pulse voltages P11 and P12, respectively.

After application of the fourth pulse voltage, the signal electrode is supplied with the third pulse voltage formed of the following eight pulse voltages P31–P38.

The on-timing of the pulse voltage P31 is coincident with the on-timing of the pulse voltage P21. The pulse voltages P31, P32, P33 and P34 have pulse widths of ta/2, (t3−ta)/2, ta/2 and (t3−ta)/2, respectively. The pulse voltages P31, P32, P33 and P34 have magnitudes of −V2, V2, V2 and −V2, respectively. The pulse intervals of the pulse voltages P31, P32, P33 and P34 are all 0.

The on-timing of the pulse voltage P35 is coincident with the on-timing of pulse voltage P23. The pulse voltages P35, P36, P37 and P38 have pulse widths of ta/2, (t3−ta)/2, ta/2 and (t3−ta)/2, respectively. The pulse voltages P35, P36, P37 and P38 have magnitudes of −V2, V2, V2 and −V2, respectively. The pulse intervals of the pulse voltages P35, P36, P37 and P38 are all 0.

The time ta is changed in accordance with the intended display tone level of the drive target pixel. Thereby, the pulse width of each of the pulse voltages P31–P38 is changed.

When the reflection factor of the drive target pixel is to be maximum, the time ta is set to 0 (ta=0). Thereby, the signal electrode is supplied with the pulse voltages P31–P38 having the pulse widths of 0, t3/2, 0, t3/2, 0, t3/2, 0 and t3/2, respectively.

When the reflection factor of the drive target pixel is to be minimum, the time ta is set to t3 (ta=t3). Thereby, the signal electrode is supplied with the pulse voltages P31–P38 having the pulse widths of t3/2, 0, t3/2, 0, t3/2, 0, t3/2 and 0, respectively.

The scanning and signal electrodes are supplied with the voltages in accordance with the drive voltage patterns shown in FIG. 8. Thereby, the liquid crystal in the drive target pixel can be first supplied with the pulse voltages P51 and P52 of the opposite polarities. Thereafter, the liquid crystal in the drive target pixel can be supplied with the pulse voltages P61, P62, P63 and P64 of the magnitudes corresponding to the intended display tone level of the drive target pixel.

Figure 9A:
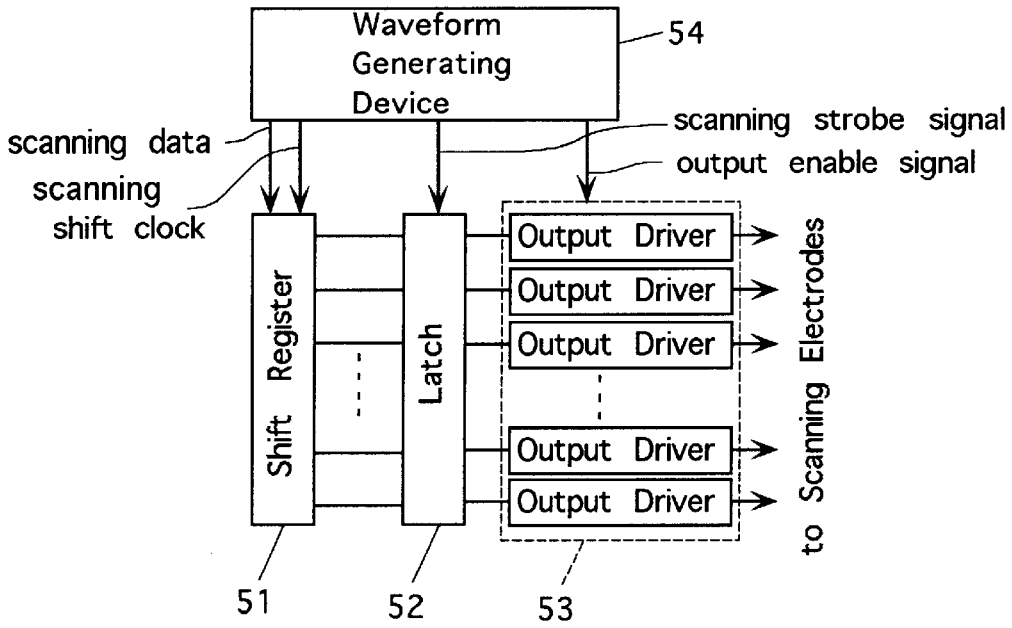
FIG. 9(A) is a schematic block diagram showing an example of the scanning electrode drive circuit.
Figure 9B:
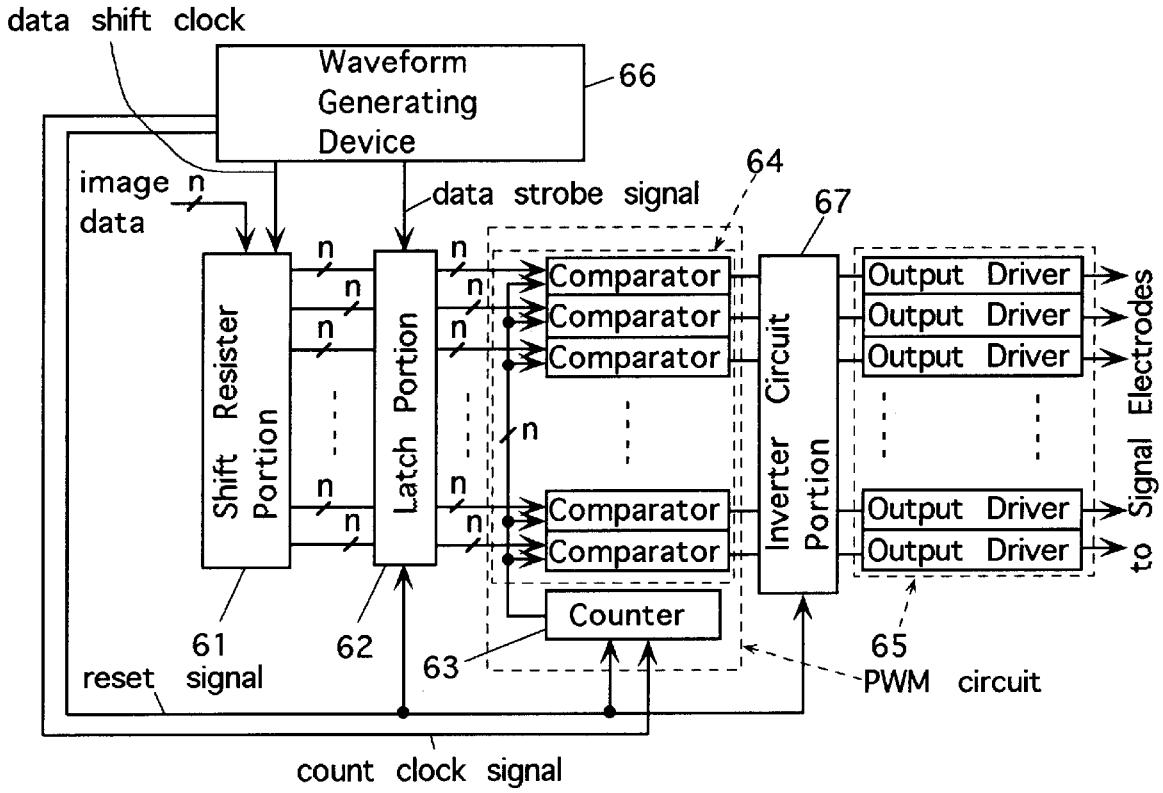
FIG. 9(B) is a schematic block diagram showing another example of the signal electrode drive circuit.

(II-6) FIGS. 9(A) and 9(B) show another example of the drive circuit. FIG. 9(A) is a schematic block diagram of a scanning electrode drive circuit. The scanning electrode drive circuit shown in FIG. 9(A) is the same as that shown in FIG. 3(A). FIG. 9(B) is a schematic block diagram showing a signal electrode drive circuit.

The signal electrode drive circuit shown in FIG. 9(B) is substantially the same as the signal electrode drive circuit shown in FIG. 3(B) except for the following structures.

In the signal electrode drive circuit shown in FIG. 9(B), an inverter circuit portion 67 is connected between the output driver portion 65 and the comparator portion 64. The inverter circuit potion 67 is supplied with a reset signal from the waveform generating device 66.

The shift register portion 61, the latch portion 62, the counter 63 and the comparator portion 64 in the signal electrode drive circuit shown in FIG. 9(B) operate similarly to those in the signal electrode drive circuit in FIG. 3(B), respectively.

Figures 10, 11:
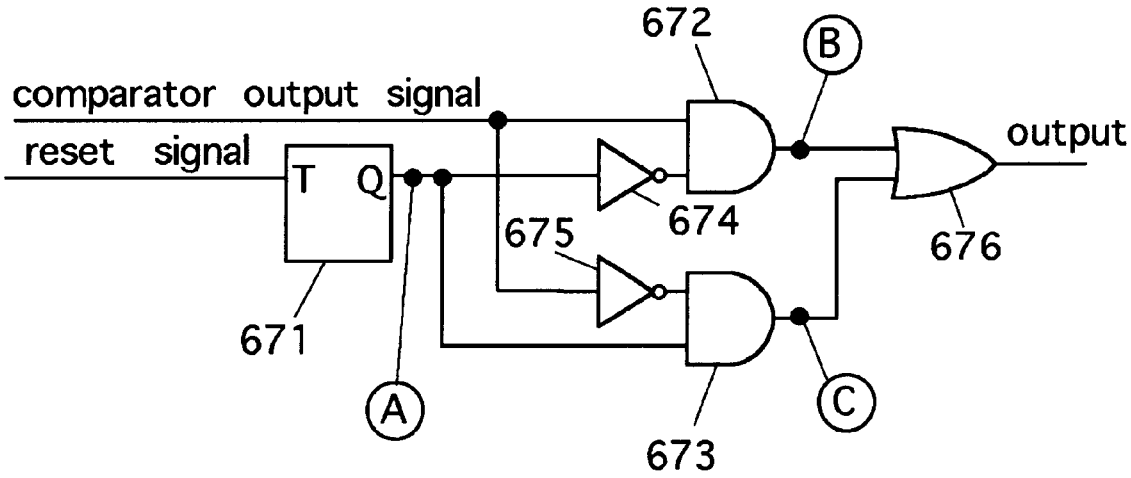
FIG. 10 shows a structure of an inverting circuit.
FIG. 11 is a truth table representing a relationship between signal voltages in the inverting circuit shown in FIG. 10.

The inverter circuit portion 67 has a plurality of inverter circuits connected to the output drivers, respectively. One of the inverter circuits is shown in FIG. 10.

The inverter circuit receives the reset signal from the waveform generating device 66, and also receives the output signal of the comparator representing the result of comparison between the tone level data and the count value.

The reset signal is supplied to a T-type (toggle type) flip-flop 671. The output of flip-flop 671 changes in synchronization with the rising of the reset signal to invert its last level (Hi or Lo level). The output of flip-flop 671 is supplied to an AND circuit 672 through a NOT circuit 674, and is also supplied to an AND circuit 673.

The output signal of the comparator is supplied to the AND circuit 672, and is also supplied to the AND circuit 673 through a NOT circuit 674.

The outputs of the AND circuits 672 and 673 are supplied to an OR circuit 676, and the output of the OR circuit 676 is supplied to the output driver.

FIG. 11 is a truth table showing a relationships between signal levels at A, B and C points in the inverter circuit shown in FIG. 10. In the inverter circuit shown in FIG. 10, it is determined, in accordance with the output level of the flip-flop 671, whether the comparator output signal is to be inverted or not. When the output level of the flip-flop 671 is high, the inverted signal of the comparator output signal is sent toward the output driver. When the output level of the flip-flop 671 is low, the same signal as the comparator output signal is sent toward the output driver.

The signal electrode drive circuit shown in FIG. 9(B) can apply pulse voltages, which have on-timing changing in accordance with the display tone level data and have constant pulse widths independent of the display tone level data, to the respective signal electrodes.

In the signal electrode drive circuit shown in FIG. 9(B), the shift register portion 61, latch portion 62, counter 63 and comparator portion 64 operate similarly to those in the signal electrode drive circuit shown in FIG. 3(B). Each comparator compares the image data (tone data) of the drive target pixel with the count value sent from the counter 63, and issues the OFF signal when the count value is not larger than the image data. It issues the ON signal when the count value is larger than the image data.

Figure 12:
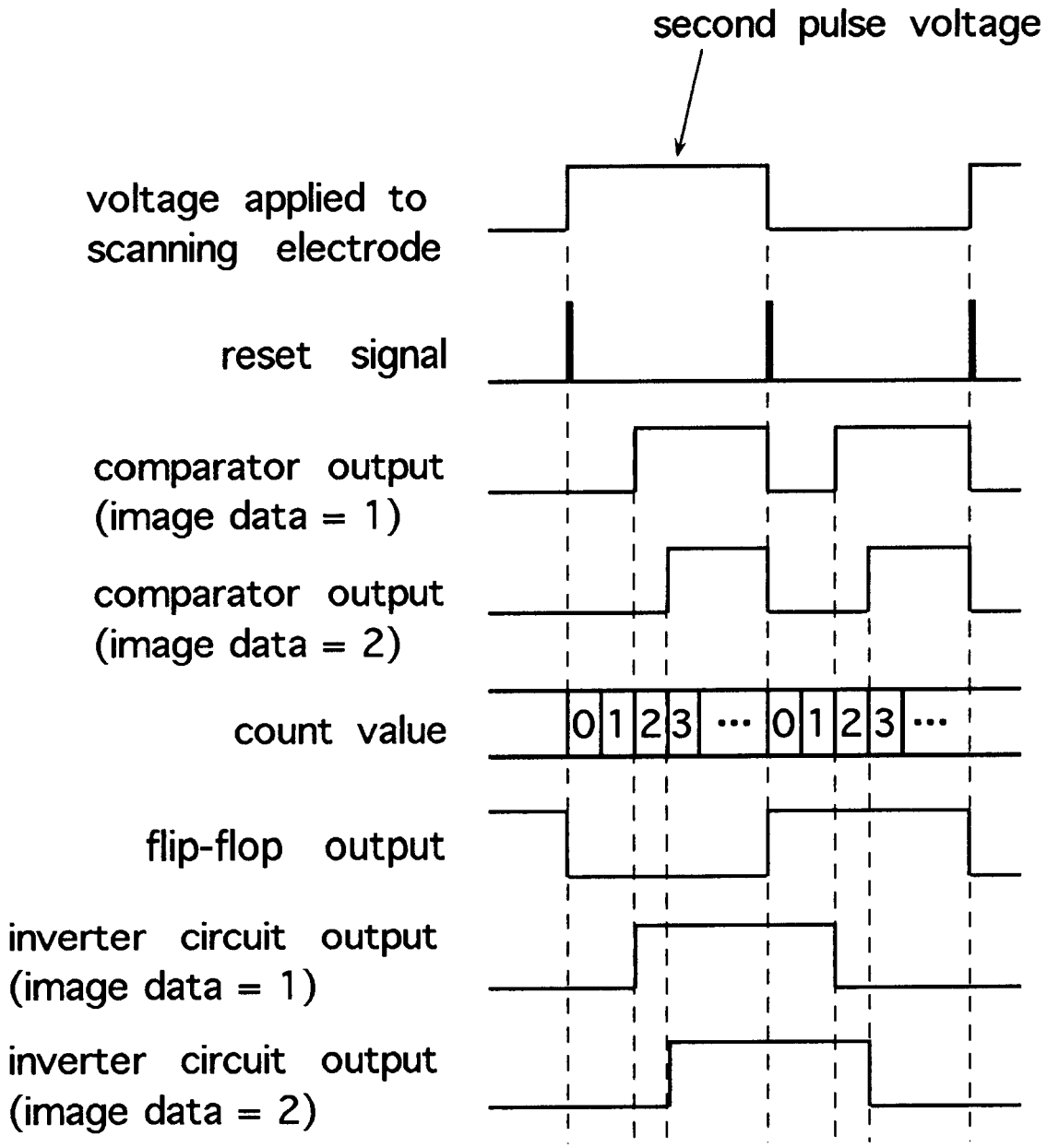
FIG. 12 shows waveforms, phases and others of respective output signals of the inverting circuit shown in FIG. 10.

Operations of the comparator, inverter circuit, counter 63 and others will now be described in detail with reference to FIG. 12. FIG. 12 shows the operations in the case where the image data (tone level data) of the drive target pixel is 2, and in the case where the image data is 3.

The reset signal is issued from the waveform generating device 66 in synchronization with the rising and falling of the second pulse voltage.

The counter starts the count-up from 0 in synchronization with the first reset signal. The output of the comparator changes from Lo (low) to Hi (high) when the count value exceeds the image data. The output of the flip-flop in the inverter circuit attains Lo when the output of the comparator changes from Lo to Hi after the first reset signal. Accordingly, the inverter circuit issues to the output driver the signal, which changes from Lo to Hi in synchronization with change of the comparator output from Lo to Hi.

As a result of the above operations, the inverter circuit issues to the output driver the signal having the on-timing which is delayed from the on-timing of the second pulse voltage by a time corresponding to the image data.

The counter restarts the count-up from 0 in synchronization with the second reset signal. The output of the comparator changes from Hi to Lo in response to the second reset signal. However, the output of the flip-flop of the inverter circuit attains Hi in response to the second reset signal so that the output of the inverter circuit does not change, and maintains Hi. The output of the comparator changes from Lo to Hi again when the count value exceeds the image data. In response to this change of the comparator output, the output of the inverter circuit changes from Hi to Lo.

Assuming that the image data is equal to X, the output of the inverter circuit is at the high (Hi) level for a period from the time when the count value after the first reset signal goes to (X+1) to the time when the count value after the second reset signal goes to (X+1). Accordingly, the width of the pulse issued from the inverter circuit is always constant independently of the image data, and is equal to the reset signal interval, i.e., the pulse width of the second pulse voltage.

Owing to the above, the signal electrode drive circuit shown in FIG. 9(B) can apply to each signal electrode the pulse voltage, which has the on-timing delayed from the on-timing of the second pulse voltage by the time corresponding to the image data, and has the constant pulse width independent of the image data.

(II-7) Referring to FIG. 13, description will now be given on another example of the manner in which the liquid crystal display device in FIG. 1 performs display in the intended display tone level on the intended pixel of the liquid crystal display element.

Figure 13:
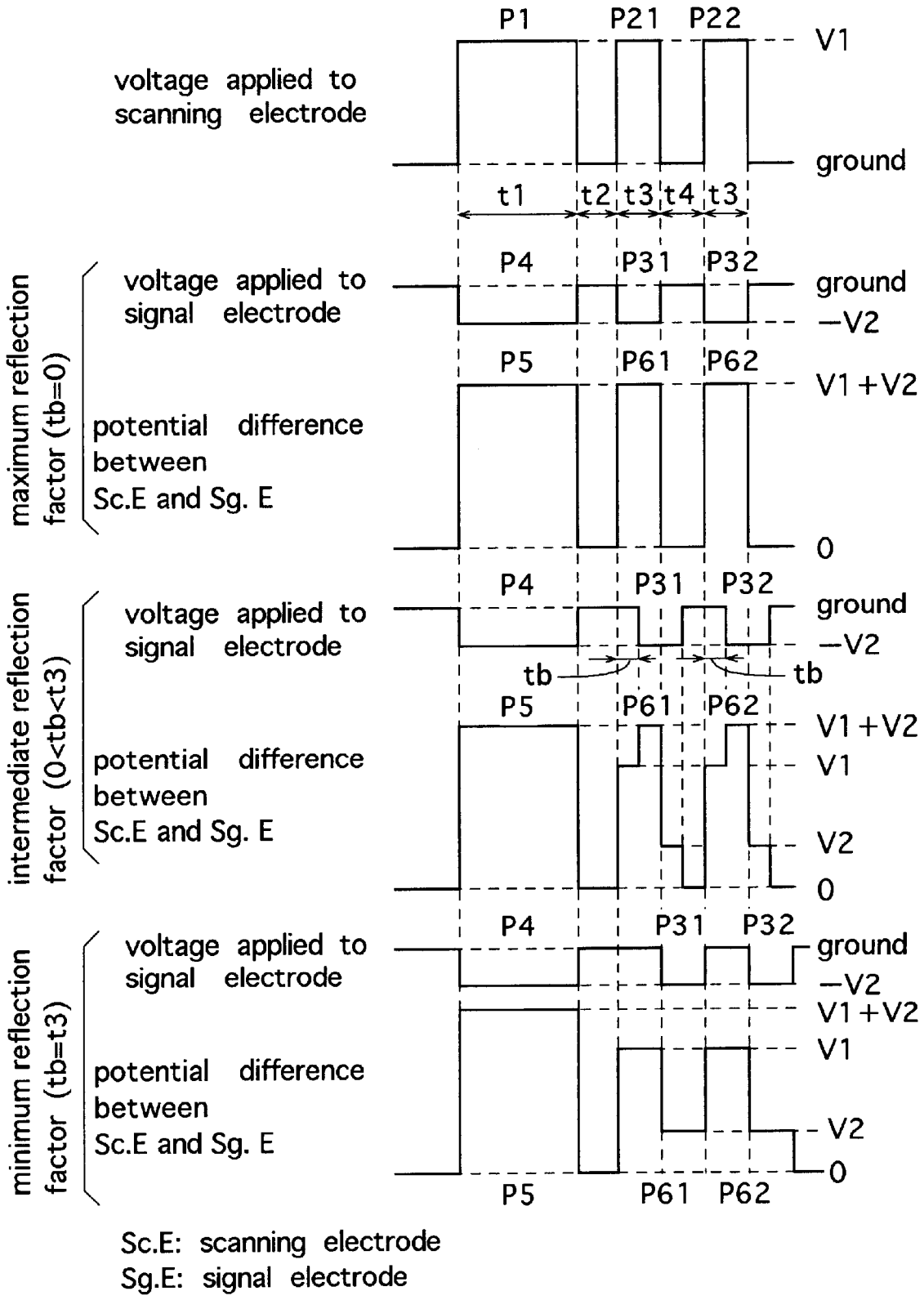
FIG. 13 shows further another example of patterns of drive voltages which are applied to the scanning electrode and the signal electrode in the method of driving the liquid crystal display element according to the invention.

FIG. 13 shows a relationship between the voltages applied to the scanning and signal electrodes corresponding to the drive target pixel and the potential difference between the scanning and signal electrodes. FIG. 13 shows the relationships in the cases where the reflection factor of the drive target pixel is to be maximum, minimum and intermediate the maximum and minimum reflection factors, respectively.

In any one of the cases where the reflection factor of the drive target pixel is to be maximum, intermediate and minimum, the scanning electrode is supplied with the first pulse voltage P1 and the second pulse voltage formed of the two pulse voltages P21 and P22 in the following manner.

The scanning electrode is first supplied with the first pulse voltage P1 of the pulse width of t1 and the magnitude of V1. After the time t2, the scanning electrode is supplied with the pulse voltage P21 of the pulse width of t3 and the magnitude of V1 as well as the pulse voltage P22 of the pulse width of t3 and the magnitude of V1 with a time interval of t4 therebetween. The two pulse voltages P21 and 22 form the second pulse voltage applied to the scanning electrode. The times t3 and t4 are merely required to satisfy the relationship of $t4 \geqq t3$, and are equal to each other in this example.

The signal electrode is supplied with the pulse voltages in the following manner.

In any one of the cases where the reflection factor of the drive target pixel is to be maximum, intermediate and minimum, the signal electrode is first supplied with the fourth pulse voltage P4 having the pulse width of t1 and the magnitude of −V2 in synchronization with the first pulse voltage P1. The on-timing and off-timing of the fourth pulse voltage are coincident with those of the first pulse voltage P1. The fourth pulse voltage P4 in this example has the polarity opposite to that of the first pulse voltage P1.

After application of the fourth pulse voltage P4, the signal electrode is supplied with the third pulse voltage formed of the two pulse voltages P31 and P32. The pulse voltages P31 and P32 have the same pulse width of t3 and the same magnitude of −V2.

The on-timing of the pulse voltages P31 and P32 is delayed from the on-timing of the pulse voltages P21 and P22 by the time tb in accordance with the intended display tone level of the drive target pixel, respectively. The pulse widths of the pulse voltages P31 and P32 are always equal to t3 independently of the intended display tone level of the drive target pixel. In this example, the pulse widths of the pulse voltages P31 and P32 forming the third pulse voltage are equal to the pulse widths of the pulse voltages P21 and P22 forming the second pulse voltage, respectively. However, the pulse width of the third pulse voltage may be larger than that of the second pulse voltage.

When the reflection factor of the drive target pixel is to be maximum, the time tb is set to 0. Thereby, the signal electrode is supplied with the pulse voltages P31 and P32 of the pulse widths of t3 in accordance with the same timing as the pulse voltages P21 and P22.

When the reflection factor of the drive target pixel is to be of an intermediate value, the on-timing of the pulse voltages P31 and P32 is delayed from the on-timing of the pulse voltages P21 and P22 by the time tb, which is set within a range from 0 to t3 ($0<tb<t3$), respectively.

When the reflection factor of the drive target pixel is to be minimum, the time tb is set to t3 ($tb=t3$). Thereby, the on-timing of the pulse voltages P31 and P32 is coincident with the off-timing of the pulse voltages P21 and P22, respectively.

According to the above, as shown in FIG. 13, the liquid crystal in the drive target pixel is supplied with the pulse voltage P5 of the width of t1 and the magnitude of (V1+V2). After the time t2, the liquid crystal in the drive target pixel is supplied with the pulse voltages P61 and P62 each having the pulse width of (t3+tb) with a time interval of (t4−tb) therebetween.

When the reflection factor of the drive target pixel is to be maximum ($tb=0$), the pulse voltages P61 and P62 have the pulse widths of t3 and the magnitudes of (V1+V2).

When the reflection factor of the drive target pixel is to be intermediate the maximum and minimum values ($0<tb<t3$), each of the pulse voltages P61 and P62 has a portion of the pulse width of tb and the magnitude of V1, a portion of the pulse width of (t3−tb) and the magnitude of (V1+V2), and a portion of the pulse width of tb and the magnitude of V2, which are arranged in this order.

When the reflection factor of the drive target pixel is to be minimum ($tb=t3$), each of the pulse voltages P61 and P62 has a portion of the pulse width of t3 and the magnitude of V1 as well as a portion of the pulse width of tb and the magnitude of V2, which are arranged in this order.

As described above, the signal electrode is supplied with the pulse voltages P31 and P32 of the same pulse widths as the pulse voltages P21 and P22 applied to the scanning electrode. The signal electrode is supplied with the third pulse voltage (pulse voltages P31 and P32) in accordance with the on-timing and off-timing, which are delayed from the on-timing and off-timing of application of the second pulse voltage (pulse voltages P21 and P22) to the scanning electrode by the time tb corresponding to the intended display tone level of the drive target pixel. Thereby, the phase of the pulse voltage P31 with respect to the phase of the pulse voltage P21 is changed from the state, where the second and third pulse voltages do not overlap with each other (where the second and third pulse voltages are not simultaneously applied) for minimizing the reflection factor, through the state, where the second and third pulse voltages partially overlap for providing the reflection factor of an intermediate value, to the state, where the second pulse voltage is included in the third pulse voltage (where the third pulse voltage is being applied whenever the second pulse voltage is being applied) for maximizing the reflection factor.

Owing to the above, the magnitudes and the pulse widths of the pulse voltages P61 and P62 applied to the liquid crystal in the drive target pixel can be changed in accordance with the intended display tone level of the drive target pixel.

The pulse voltage P5 has the magnitude and the width, which can set the liquid crystal in the drive target pixel to the homeotropic state. Each voltage portion forming the pulse voltages P61 and P62 is set such that the liquid crystal can have the homeotropic state again or the incomplete homeotropic state after stop of application of the pulse voltage P5. Thus, the length of the time tb is controlled in accordance with the required display tone level of the drive target pixel, whereby it is possible to control the width of each of the voltage portions of the pulse voltages P61 and P62 applied to the liquid crystal in the drive target pixel, and the liquid crystal can be set to the intended state among the planar state, focal conic state or the intermediate them. By effecting the above control on each pixel, the image in the multiple tone levels can be displayed by selectively setting the liquid crystal display element to the state of the maximum reflection factor, the minimum reflection factor and the intermediate reflection factor.

According to the drive pattern shown in FIG. 13, as described above, the scanning and signal electrodes corresponding to the drive target pixel are supplied with the pulse voltages in the following manner. The scanning electrode corresponding to the drive target pixel is supplied with the second pulse voltage subsequently to the first pulse voltage. The signal electrode corresponding to the drive target pixel is supplied with the third pulse voltage having the pulse width equal to or larger than that of the second pulse voltage in synchronization with the second pulse voltage. In application of the third pulse voltage, control based on the required display tone level of the drive target pixel is effected on the on-timing and/or off-timing of the third pulse voltage with respect to the on-timing and/or off-timing of the second pulse voltage. Thereby, the phase of the third pulse voltage with respect to the phase of the second pulse voltage is changed in accordance with the required display tone level of the drive target pixel between the state, where the second and third pulse voltages do not overlap with each other, and the state, where the second pulse voltage is included in the third pulse voltage.

(II-8) Description will now be given on a specific experimental example 2, in which an experimental display device similar to that used in the foregoing experimental example 1 was used, and the pulse voltages were applied to the predetermined pixel in accordance with the pattern shown in FIG. 13. The manner of measuring the transmission factors was the same as that in the experimental example 1.

Figure 14:
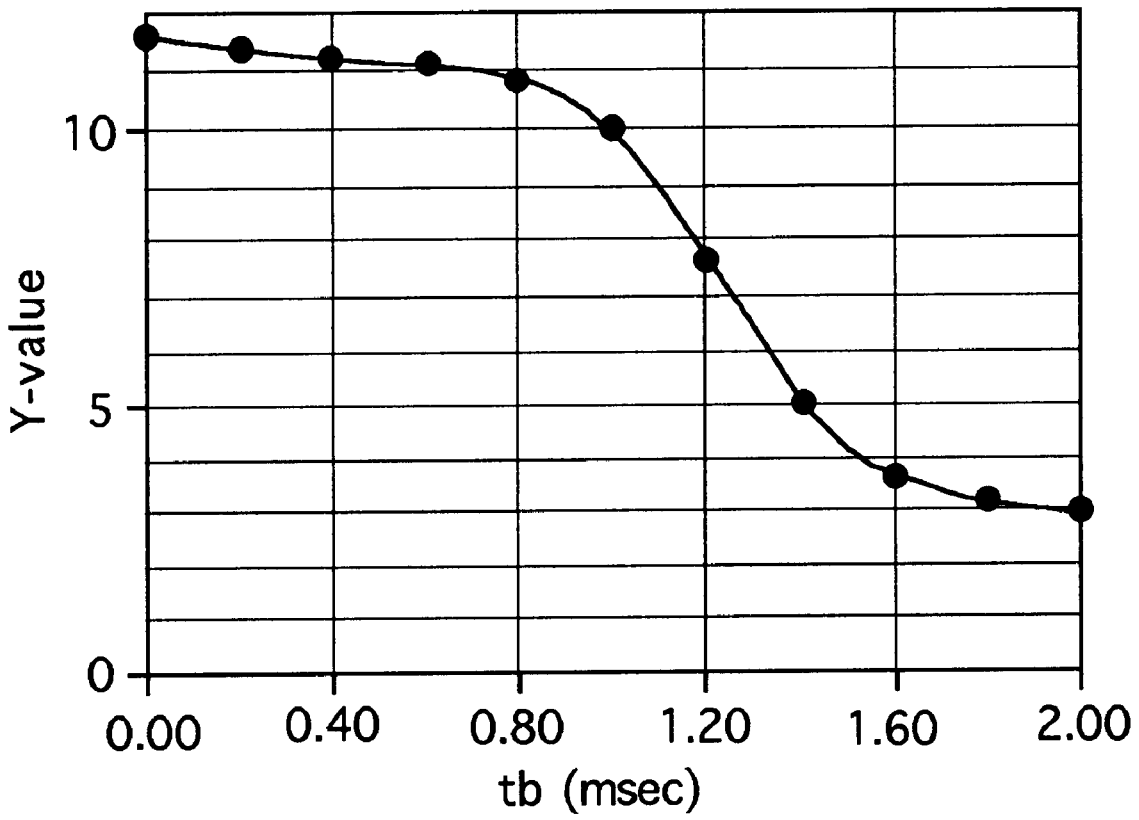
FIG. 14 shows an example of a relationship between delay of application of the third pulse voltage from application of the second pulse voltage and the spectral reflection factor of the liquid crystal display element in the case where the voltages are applied to the liquid crystal display element according to the drive pattern shown in FIG. 13.

The voltages were applied under the conditions of V1=140 V, V2=30 V, t1=5 msec, t2=2 msec, t3=2 msec and t4=2 msec. Application of the pulse voltages P31 and P32 was delayed from application of the pulse voltages P21 and P22 by the delay time tb, which was variable in a range from 0 msec to 2 msec. FIG. 14 shows a relationship between the delay tb and the spectral reflection factor (Y-value) of the liquid crystal display element. When the delay tb is equal to or lower than 0.6 msec, the Y-value is equal to or larger than 11. When the delay tb is equal to or larger than 1.6 msec, the Y-value is equal to or smaller than 4. When the delay tb is in a range from 0.6 to 1.6 msec, the Y-value continuously change in a range from 4 to 11. From the above, by employing the second and third pulse voltages having the same pulse widths, and by shifting the on-timing of the third pulse voltage from the on-timing of the second pulse voltage for changing the phase, the display state of the liquid crystal can be continuously changed.

(II-9) Referring to FIG. 15, still another example of the pattern of the drive voltages applied to the scanning and signal electrodes will be described below.

Figure 15:
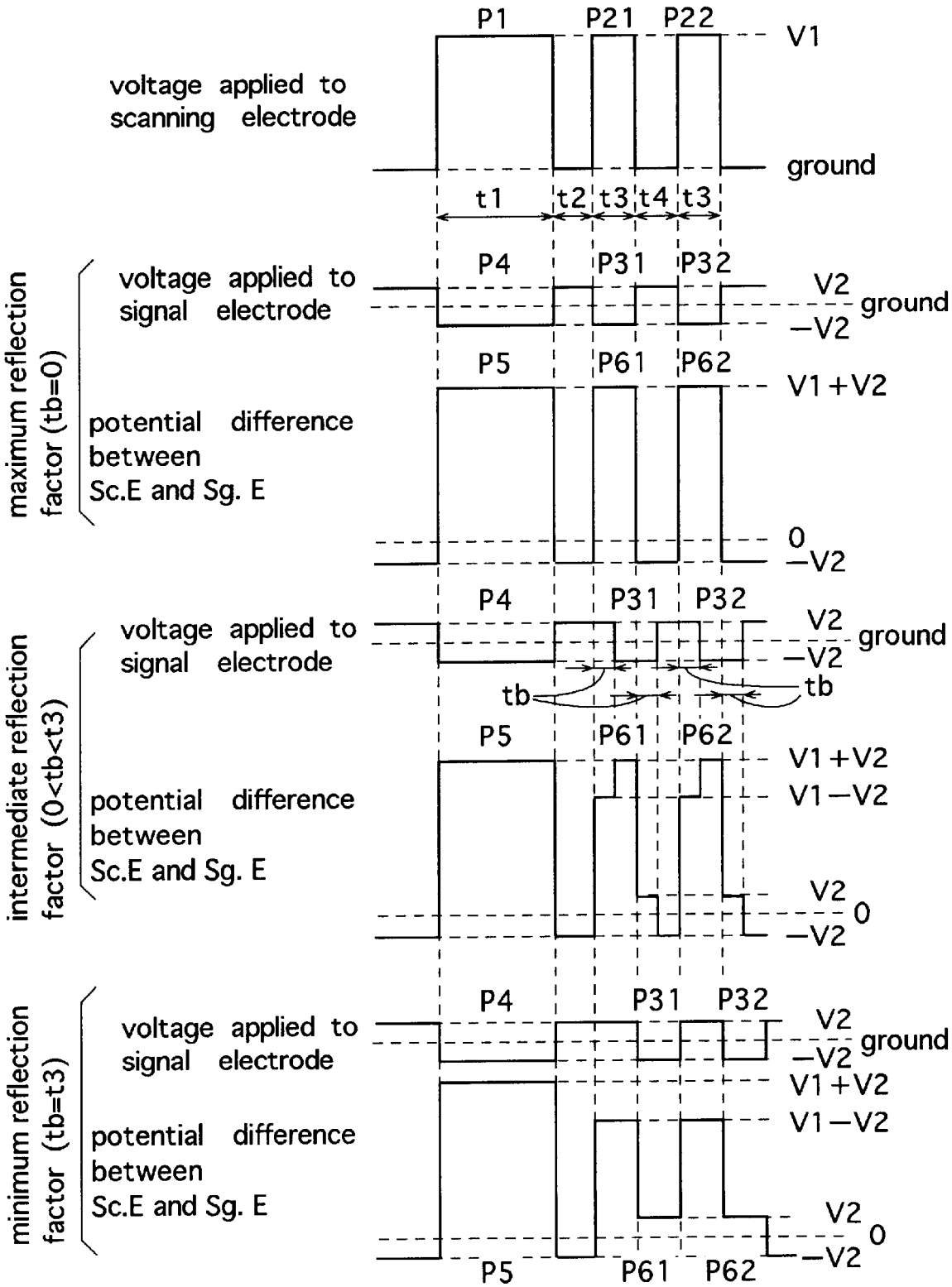
FIG. 15 shows further another example of patterns of drive voltages which are applied to the scanning electrode and the signal electrode in the method of driving the liquid crystal display element according to the invention.

According to the drive pattern shown in FIG. 15, the scanning electrode is supplied with the first pulse voltage P1 and the second pulse voltage formed of the two pulse voltages P21 and P22 in accordance with the same drive pattern as that shown in FIG. 13. In this example, t4 is also equal to t3.

The signal electrode is supplied with the pulse voltages in the following manner in accordance with the intended display tone level of the drive target pixel.

When the reflection factor of the drive target pixel is to be set to an intermediate value, the operation and control is performed as follows. The signal electrode is supplied with the fourth pulse voltage P4 of the pulse width of t1 in accordance with the same timing as the first pulse voltage P1. The fourth pulse voltage P4 has the off level of V2 and the on level of −V2. The signal electrode is further supplied with the third pulse voltage formed of the two pulse voltages P31 and P32. Each of the pulse voltages P31 and P32 has the off level of V2 and the on level of −V2. Each of the pulse voltages P31 and P32 in this example has the pulse width of t3 equal to those of the pulse voltages P21 and p22. The pulse voltages P31 and P32 are applied with a delay of tb, which corresponds to the intended display tone level of the drive target pixel, from the on-timing of the pulse voltages P21 and P22, respectively.

When the reflection factor of the drive target pixel is to be maximum, tb is set to 0. Thereby, the signal electrode is supplied with the pulse voltages P31 and P32 having the pulse widths of t3 in accordance with the same timing as the pulse voltages P21 and P22.

When the reflection factor of the drive target pixel is to be minimum, tb is set to t3. Thereby, the on-timing of the pulse voltages P31 and P32 coincide with the off-timing of the pulse voltages P21 and P22, respectively.

According to the above, the magnitudes and pulse widths of the pulse voltages P61 and P62 applied to the liquid crystal in the drive target pixel can be changed in accordance with the intended display tone level of the drive target pixel.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid crystal display device comprising:

a liquid crystal display element having a first substrate provided with a plurality of scanning electrodes, a second substrate provided with a plurality of signal electrodes, and a liquid crystal display layer held between said first and second substrates; and a drive voltage applying device for applying a scanning voltage to said scanning electrodes and applying a signal voltage to said signal electrodes, wherein said drive voltage applying device controls the liquid crystal display element in a manner which comprises:

applying a first pulse voltage to a scanning electrode corresponding to a drive target pixel in said liquid crystal display layer for changing the liquid crystal material of said drive target pixel to a predetermined changed state;

applying, subsequently to said first pulse voltage, a second pulse voltage to said scanning electrode corresponding to said drive target pixel as well as a third pulse voltage to a signal electrode corresponding to said drive target pixel in synchronization with said second pulse voltage for stabilizing the state of the liquid crystal material of said drive target pixel in a predetermined stabilized state; and controlling a pulse width of said third pulse voltage in accordance with required display tone of said drive target pixel.

2. A liquid crystal display device according to claim 1, wherein said first pulse voltage is a voltage for changing the liquid crystal material of said drive target pixel to a homeotropic state as said predetermined changed state, and wherein said second and third pulse voltages are voltages for stabilizing the liquid crystal material of said drive target pixel in a planar state, a focal conic state or a state intermediate the planar and focal conic states as said predetermined stabilized state in accordance with the required display tone of said drive target pixel.

3. A liquid crystal display device according to claim 1, wherein said drive voltage applying device further applies a fourth pulse voltage to said signal electrode corresponding to said drive target pixel in synchronization with said first pulse voltage for changing, together with said first pulse voltage, the liquid crystal material of said drive target pixel to said predetermined changed state.

4. A liquid crystal display device according to claim 3, wherein said first and second pulse voltages are of the same magnitude, wherein said drive voltage applying device applies the first and second pulse voltages of the same magnitude to each of the scanning electrodes corresponding to drive target pixels, wherein said third and fourth pulse voltages are of the same magnitude, and wherein said drive voltage applying device applies the third and fourth pulse voltages of the same magnitude to each of the signal electrodes corresponding to the drive target pixels.

5. A liquid crystal display device according to claim 1, wherein said first and second pulse voltages are of the same magnitude, and wherein said drive voltage applying device applies the first and second pulse voltages of the same magnitude to each of the scanning electrodes corresponding to drive target pixels, and applies the third pulse voltage of the same magnitude to each of the signal electrodes corresponding to the drive target pixels.

6. A liquid crystal display device according to claim 1, wherein a plurality of said liquid crystal display elements are provided, wherein said liquid crystal display elements are layered together, and wherein each of said liquid crystal display elements is controlled in said manner.

7. A liquid crystal display device according to claim 1, wherein polarities of said first and second pulse voltages are opposite to polarity of said third pulse voltage.

8. A liquid crystal display device comprising:

a liquid crystal display element having a first substrate provided with a plurality of scanning electrodes, a second substrate provided with a plurality of signal electrodes, and a liquid crystal display layer held between said first and second substrates; and a drive voltage applying device for applying a scanning voltage to said scanning electrodes and applying a signal voltage to said signal electrodes, wherein said drive voltage applying device controls the liquid crystal display element in a manner which comprises:

applying a first pulse voltage to said scanning electrode corresponding to a drive target pixel in said liquid crystal display layer for changing the liquid crystal material of said drive target pixel to a predetermined changed state;

applying, subsequently to said first pulse voltage, a second pulse voltage to a scanning electrode corresponding to said drive target pixel as well as a third pulse voltage having a pulse width equal to or larger than the pulse width of said second pulse voltage to a signal electrode corresponding to said drive target pixel in synchronization with said second pulse voltage for stabilizing the state of the liquid crystal material of said drive target pixel in a predetermined stabilized state; and controlling on-timing of said third pulse voltage with respect to on-timing of said second pulse voltage and/or off-timing of said third pulse voltage with respect to off-timing of said second pulse voltage to change the phase of said third pulse voltage with respect to the phase of said second pulse voltage within a range from a state where said second and third pulse voltages do not overlap with each other, to a state where said second pulse voltage is included in said third pulse voltage in accordance with required display tone of said drive target pixel.

9. A liquid crystal display device according to claim 8, wherein said first pulse voltage is a voltage for changing the liquid crystal material of said drive target pixel to a homeotropic state as said predetermined changed state, and wherein said second and third pulse voltages are voltages for stabilizing the liquid crystal material of said drive target pixel in a planar state, a focal conic state or a state intermediate the planar and focal conic states as said predetermined stabilized state in accordance with the required display tone of said drive target pixel.

10. A liquid crystal display device according to claim 8, wherein said drive voltage applying device further applies a fourth pulse voltage to said signal electrode corresponding to said drive target pixel in synchronization with said first pulse voltage for changing, together with said first pulse voltage, the liquid crystal material of said drive target pixel to said predetermined changed state.

11. A liquid crystal device according to claim 10, wherein said first and second pulse voltages are of the same magnitude, wherein said drive voltage applying device applies the first and second pulse voltages of the same magnitude to each of the scanning electrodes corresponding to the drive target pixels, wherein said third and fourth pulse voltages are of the same magnitude, and wherein said drive voltage applying device applies the third and fourth pulse voltages of the same magnitude to each of the signal electrodes corresponding to the drive target pixels.

12. A liquid crystal display device according to claim 8, wherein said first, second, and third pulse voltages are of the same magnitude, and wherein said drive voltage applying device applies the first and second pulse voltages of the same magnitude to each of the scanning electrodes corresponding to the drive target pixels, and applies the third pulse voltage of the same magnitude to each of the signal electrodes corresponding to the drive target pixels.

13. A liquid crystal display device according to claim 8, wherein a plurality of said liquid crystal display elements are provided, wherein said liquid crystal display elements are layered together, and wherein each of said liquid crystal display elements is controlled in said manner.

14. A liquid crystal display device according to claim 8, wherein polarities of said first and second pulse voltages are opposite to polarity of said third pulse voltage.

15. A method of driving a liquid crystal display element having a first substrate provided with a scanning electrode, a second substrate provided with a signal electrode and a liquid crystal display layer held between said first and second substrates, said method comprising the steps of:

(a) applying a first pulse voltage to a scanning electrode corresponding to a drive target pixel in said liquid crystal display layer for changing the liquid crystal material of said drive target pixel to a predetermined changed state;

(b) applying, subsequent to said step (a), a second pulse voltage to said scanning electrode corresponding to said drive target pixel; and (c) controlling a pulse width of a third pulse voltage in accordance with a required display tone of said drive target pixel, and applying the third pulse voltage to said signal electrode corresponding to said drive target pixel in synchronization with said second pulse voltage for stabilizing the state of the liquid crystal material of said drive target pixel in a predetermined stabilized state.

16. A method of driving the liquid crystal display element according to claim 15, wherein said first pulse voltage is a voltage for changing the liquid crystal material of said drive target pixel to a homeotropic state as said predetermined changed state, and wherein said second and third pulse voltages are voltages for stabilizing the liquid crystal material of said drive target pixel in a planar state, a focal conic state or a state intermediate the planar and focal conic states as said predetermined stabilized state in accordance with the required display tone of said drive target pixel.

17. A method of driving the liquid crystal display element according to claim 15, further comprising the step of:

(d) applying a fourth pulse voltage to said signal electrode corresponding to said drive target pixel in synchronization with said first pulse voltage for changing, together with said first pulse voltage, the liquid crystal material of said drive target pixel to said predetermined changed state.

18. A method of driving the liquid crystal display element according to claim 17, wherein said first and second pulse voltages are of the same magnitude, wherein the first and second pulse voltages of the same magnitude are applied to each of the scanning electrodes corresponding to the drive target pixels, wherein said third and fourth pulse voltages are of the same magnitude, and wherein the third and fourth pulse voltages of the same magnitude are applied to each of the signal electrodes corresponding to the drive target pixels.

19. A method of driving the liquid crystal display element according to claim 15, wherein said first and second pulse voltages are of the same magnitude, wherein the first and second pulse voltages of the same magnitude are applied to each of the scanning electrodes corresponding to the drive target pixels, and wherein the third pulse voltage of the same magnitude is applied to each of the signal electrodes corresponding to the drive target pixels.

20. A method of driving the liquid crystal display element according to claim 15, wherein polarities of said first and second pulse voltages are opposite to polarity of said third pulse voltage.

21. A method of driving the liquid crystal display element having a first substrate provided with a scanning electrode, a second substrate provided with a signal electrode and a liquid crystal display layer held between said first and second substrates, said method comprising the steps of:

(a) applying a first pulse voltage to said scanning electrode corresponding to a drive target pixel in said liquid crystal display layer for changing the liquid crystal material of said drive target pixel to a predetermined changed state;

(b) applying, subsequent to said step (a), a second pulse voltage to said scanning electrode corresponding to said drive target pixel; and (c) applying a third pulse voltage, having a pulse width equal to or larger than a pulse width of said second pulse voltage, to said signal electrode corresponding to said drive target pixel, with controlling an on-timing of said third pulse voltage with respect to an on-timing of said second pulse voltage and/or an off-timing of said third pulse voltage with respect to an off-timing of said second pulse voltage to change a phase of said third pulse voltage with respect to a phase of said second pulse voltage within a range from a state where said second and third pulse voltages do not overlap with each other, to a state where said second pulse voltage is included in said third pulse voltage in accordance with a required display tone of said drive target pixel.

22. A method of driving the liquid crystal display element according to claim 21, wherein said first pulse voltage is a voltage for changing the liquid crystal material of said target pixel to a homeotropic state as said predetermined changed state, and wherein said second and third pulse voltages are voltages for stabilizing the liquid crystal material of said drive target pixel in a planar state, a focal conic state or a state intermediate the planar and focal conic states as said predetermined stabilized state in accordance with the required display tone of said drive target pixel.

23. A method of driving the liquid crystal display element according to claim 21, further comprising the step of:

(d) applying a fourth pulse voltage to said signal electrode corresponding to said drive target pixel in synchronization with said first pulse voltage for changing, together with said first pulse voltage, the liquid crystal material of said drive target pixel to said predetermined changed state.

24. A method of driving the liquid crystal display element according to claim 21, wherein said first and second pulse voltages are of the same magnitude, wherein the first and second pulse voltages of the same magnitude are applied to each of the scanning electrodes corresponding to the drive target pixels, and wherein the third pulse voltages of the same magnitude is applied to each of the signal electrodes corresponding to the drive target pixels.

25. A method of driving the liquid crystal display element according to claim 23, wherein said first and second pulse voltages are of the same magnitude, wherein the first and second pulse voltages of the same magnitude are applied to said scanning electrode corresponding to the drive target pixel, wherein said third and fourth pulse voltages are of the same magnitude, and wherein the third and fourth pulse voltages of the same magnitude are applied to said signal electrode corresponding to the drive target pixel.

26. A method of driving the liquid crystal display element according to claim 21, wherein polarities of said first and second pulse voltages are opposite to polarity of said third pulse voltage.

* * * * *